US007191840B2

(12) United States Patent
Pietras et al.

(10) Patent No.: US 7,191,840 B2
(45) Date of Patent: Mar. 20, 2007

(54) CASING RUNNING AND DRILLING SYSTEM

(75) Inventors: Bernd-Georg Pietras, Wedgemark (DE); Thomas F. Bailey, Houston, TX (US); Adrian Vuyk, Jr., Houston, TX (US); Carl J. Wilson, Hockley, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/794,795

(22) Filed: Mar. 5, 2004

(65) Prior Publication Data

US 2004/0216924 A1 Nov. 4, 2004

Related U.S. Application Data

(60) Provisional application No. 60/451,964, filed on Mar. 5, 2003.

(51) Int. Cl.
*E21B 19/16* (2006.01)
*E21B 19/10* (2006.01)
*E21B 7/20* (2006.01)

(52) U.S. Cl. ..... 166/380; 166/71; 166/77.3; 166/85.1; 175/113; 175/171; 175/423; 294/86.12

(58) Field of Classification Search ..... 166/380, 166/382, 77.52, 77.53, 85.1, 71, 379, 77.1; 175/423, 57, 113, 170, 171; 294/86.24, 86.25, 294/86.26, 86.12
See application file for complete search history.

(56) References Cited

U.S. PATENT DOCUMENTS 122,514 A 1/1872 Bullock
179,973 A 7/1876 Thornton
1,077,772 A 11/1913 Weathersby
1,185,582 A 5/1916 Bignell
1,301,285 A 4/1919 Leonard
1,342,424 A 6/1920 Cotten
1,418,766 A 6/1922 Wilson (Continued)

FOREIGN PATENT DOCUMENTS

CA 2 307 386 11/2000

(Continued)

OTHER PUBLICATIONS

PCT Invitation to Pay Additional Fees, International Application No. PCT/US2004/006751, dated Aug. 19, 2004.

(Continued)

*Primary Examiner*—Kenneth Thompson
(74) *Attorney, Agent, or Firm*—Patterson & Sheridan, LLP

(57) ABSTRACT

A method and apparatus for holding and turning a tubular and string of tubulars, such as casing, for make-up and drilling with the tubulars are disclosed. The apparatus generally includes a spear and a clamping head, both of which are mounted to a top drive. The spear and the clamping head can be engaged to transmit torque therebetween from the top drive. In addition, an aspect of the invention provides variable height wickers positioned on slips to enable use of the slips with variable inner diameter (ID) and weight casing without deformation or rupture of the casing. Still further, a casing collar is also provided to provide reinforcement to the casing in the area of slip contact with the casing ID.

45 Claims, 13 Drawing Sheets

U.S. PATENT DOCUMENTS

| | | | | |
|---|---|---|---|---|
| 1,471,526 | A | | 10/1923 | Pickin |
| 1,585,069 | A | | 5/1926 | Youle |
| 1,728,136 | A | | 9/1929 | Power |
| 1,777,592 | A | | 10/1930 | Thomas |
| 1,805,007 | A | | 5/1931 | Pedley |
| 1,825,026 | A | | 9/1931 | Thomas |
| 1,830,625 | A | | 11/1931 | Schrock |
| 1,842,638 | A | | 1/1932 | Wigle |
| 1,880,218 | A | | 10/1932 | Simmons |
| 1,917,135 | A | | 7/1933 | Littell |
| 1,981,525 | A | | 11/1934 | Price |
| 1,998,833 | A | | 4/1935 | Crowell |
| 2,017,451 | A | | 10/1935 | Wickersham |
| 2,049,450 | A | | 8/1936 | Johnson |
| 2,060,352 | A | | 11/1936 | Stokes |
| 2,105,885 | A | | 1/1938 | Hinderliter |
| 2,128,430 | A | * | 8/1938 | Pryor ..... 294/86.21 |
| 2,167,338 | A | | 7/1939 | Murcell |
| 2,184,681 | A | | 12/1939 | Osmun et al. |
| 2,214,429 | A | | 9/1940 | Miller |
| 2,216,895 | A | | 10/1940 | Stokes |
| 2,228,503 | A | | 1/1941 | Boyd et al. |
| 2,295,803 | A | | 9/1942 | O'Leary |
| 2,305,062 | A | | 12/1942 | Church et al. |
| 2,324,679 | A | | 7/1943 | Cox |
| 2,370,832 | A | | 3/1945 | Baker |
| 2,379,800 | A | | 7/1945 | Hare |
| 2,414,719 | A | | 1/1947 | Cloud |
| 2,499,630 | A | | 3/1950 | Clark |
| 2,522,444 | A | | 9/1950 | Grable |
| 2,536,458 | A | | 1/1951 | Munsinger |
| 2,570,080 | A | | 10/1951 | Stone |
| 2,610,690 | A | | 9/1952 | Beatty |
| 2,621,742 | A | | 12/1952 | Brown |
| 2,627,891 | A | | 2/1953 | Clark |
| 2,641,444 | A | | 6/1953 | Moon |
| 2,650,314 | A | | 8/1953 | Hennigh et al. |
| 2,663,073 | A | | 12/1953 | Bieber et al. |
| 2,668,689 | A | | 2/1954 | Cormany |
| 2,692,059 | A | | 10/1954 | Bolling, Jr. |
| 2,720,267 | A | | 10/1955 | Brown |
| 2,738,011 | A | | 3/1956 | Mabry |
| 2,741,907 | A | | 4/1956 | Genender et al. |
| 2,743,087 | A | | 4/1956 | Layne et al. |
| 2,743,495 | A | | 5/1956 | Eklund |
| 2,764,329 | A | | 9/1956 | Hampton |
| 2,765,146 | A | | 10/1956 | Williams |
| 2,805,043 | A | | 9/1957 | Williams |
| 2,953,406 | A | | 9/1960 | Young |
| 2,965,177 | A | | 12/1960 | Bus, Sr. et al. |
| 2,978,047 | A | | 4/1961 | DeVaan |
| 3,006,415 | A | | 10/1961 | Burns et al. |
| 3,041,901 | A | | 7/1962 | Knights |
| 3,054,100 | A | | 9/1962 | Jones |
| 3,087,546 | A | | 4/1963 | Wooley |
| 3,090,031 | A | | 5/1963 | Lord |
| 3,102,599 | A | | 9/1963 | Hillburn |
| 3,111,179 | A | | 11/1963 | Albers et al. |
| 3,117,636 | A | | 1/1964 | Wilcox et al. |
| 3,122,811 | A | | 3/1964 | Gilreath |
| 3,123,160 | A | | 3/1964 | Kammerer |
| 3,124,023 | A | | 3/1964 | Marquis et al. |
| 3,131,769 | A | | 5/1964 | Rochemont |
| 3,159,219 | A | | 12/1964 | Scott |
| 3,169,592 | A | | 2/1965 | Kammerer |
| 3,191,677 | A | | 6/1965 | Kinley |
| 3,191,680 | A | | 6/1965 | Vincent |
| 3,193,116 | A | | 7/1965 | Kenneday et al. |
| 3,266,582 | A | | 8/1966 | Homanick |
| 3,353,599 | A | | 11/1967 | Swift |
| 3,380,528 | A | | 4/1968 | Timmons |
| 3,387,893 | A | | 6/1968 | Hoever |
| 3,392,609 | A | | 7/1968 | Bartos |
| 3,419,079 | A | | 12/1968 | Current |
| 3,477,527 | A | | 11/1969 | Koot |
| 3,489,220 | A | | 1/1970 | Kinley |
| 3,518,903 | A | | 7/1970 | Ham et al. |
| 3,548,936 | A | | 12/1970 | Kilgore et al. |
| 3,550,684 | A | | 12/1970 | Cubberly, Jr. |
| 3,552,507 | A | | 1/1971 | Brown |
| 3,552,508 | A | | 1/1971 | Brown |
| 3,552,509 | A | | 1/1971 | Brown |
| 3,552,510 | A | | 1/1971 | Brown |
| 3,552,848 | A | | 1/1971 | Van Wagner |
| 3,559,739 | A | | 2/1971 | Hutchinson |
| 3,566,505 | A | | 3/1971 | Martin |
| 3,570,598 | A | | 3/1971 | Johnson |
| 3,575,245 | A | | 4/1971 | Cordary et al. |
| 3,602,302 | A | | 8/1971 | Kluth |
| 3,603,411 | A | | 9/1971 | Link |
| 3,603,412 | A | | 9/1971 | Kammerer, Jr. et al. |
| 3,603,413 | A | | 9/1971 | Grill et al. |
| 3,606,664 | A | | 9/1971 | Weiner |
| 3,624,760 | A | | 11/1971 | Bodine |
| 3,635,105 | A | | 1/1972 | Dickmann et al. |
| 3,638,989 | A | | 2/1972 | Sandquist |
| 3,656,564 | A | | 4/1972 | Brown |
| 3,662,842 | A | | 5/1972 | Bromell |
| 3,669,190 | A | | 6/1972 | Sizer et al. |
| 3,680,412 | A | | 8/1972 | Mayer et al. |
| 3,691,624 | A | | 9/1972 | Kinley |
| 3,691,825 | A | | 9/1972 | Dyer |
| 3,692,126 | A | | 9/1972 | Rushing et al. |
| 3,696,332 | A | | 10/1972 | Dickson, Jr. et al. |
| 3,697,113 | A | * | 10/1972 | Palauro et al. ..... 294/86.24 |
| 3,700,048 | A | | 10/1972 | Desmoulins |
| 3,706,347 | A | | 12/1972 | Brown |
| 3,729,057 | A | | 4/1973 | Werner |
| 3,746,330 | A | | 7/1973 | Taciuk |
| 3,747,675 | A | | 7/1973 | Brown |
| 3,760,894 | A | | 9/1973 | Pitifer |
| 3,776,320 | A | | 12/1973 | Brown |
| 3,776,991 | A | | 12/1973 | Marcus |
| 3,780,883 | A | | 12/1973 | Brown |
| 3,785,193 | A | | 1/1974 | Kinley et al. |
| 3,808,916 | A | | 5/1974 | Porter et al. |
| 3,838,613 | A | | 10/1974 | Wilms |
| 3,840,128 | A | | 10/1974 | Swoboda, Jr. et al. |
| 3,848,684 | A | | 11/1974 | West |
| 3,857,450 | A | | 12/1974 | Guier |
| 3,870,114 | A | | 3/1975 | Pulk et al. |
| 3,871,618 | A | | 3/1975 | Funk |
| 3,881,375 | A | | 5/1975 | Kelly |
| 3,885,679 | A | | 5/1975 | Swoboda, Jr. et al. |
| 3,901,331 | A | | 8/1975 | Djurovic |
| 3,913,687 | A | | 10/1975 | Gyongyosi et al. |
| 3,915,244 | A | | 10/1975 | Brown |
| 3,934,660 | A | | 1/1976 | Nelson |
| 3,945,444 | A | | 3/1976 | Knudson |
| 3,947,009 | A | | 3/1976 | Nelmark |
| 3,964,552 | A | | 6/1976 | Slator |
| 3,964,556 | A | | 6/1976 | Gearhart et al. |
| 3,980,143 | A | | 9/1976 | Swartz et al. |
| 4,049,066 | A | | 9/1977 | Richey |
| 4,054,332 | A | | 10/1977 | Bryan, Jr. |
| 4,054,426 | A | | 10/1977 | White |
| 4,064,939 | A | | 12/1977 | Marquis |
| 4,077,525 | A | | 3/1978 | Callegari et al. |
| 4,082,144 | A | | 4/1978 | Marquis |
| 4,083,405 | A | | 4/1978 | Shirley |
| 4,085,808 | A | | 4/1978 | Kling |
| 4,095,865 | A | | 6/1978 | Denison et al. |
| 4,100,968 | A | | 7/1978 | Delano |
| 4,100,981 | A | | 7/1978 | Chaffin |

4,127,927 A 12/1978 Hauk et al.
4,133,396 A 1/1979 Tschirky
4,142,739 A 3/1979 Billingsley
4,173,457 A 11/1979 Smith
4,175,619 A 11/1979 Davis
4,186,628 A 2/1980 Bonnice
4,189,185 A 2/1980 Kammerer, Jr. et al.
4,194,383 A 3/1980 Huzyak
4,202,225 A 5/1980 Sheldon et al.
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,311,195 A 1/1982 Mullins, II
4,315,553 A 2/1982 Stallings
4,320,915 A 3/1982 Abbott et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,584 A 6/1986 Neves
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,613,161 A 9/1986 Brisco
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,899,816 A 2/1990 Mine
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,971,146 A * 11/1990 Terrell ..... 166/55
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.

5,085,273 A 2/1992 Coone
5,096,465 A 3/1992 Chen et al.
5,107,940 A 4/1992 Berry
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tassari et al.
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,280 A 3/1996 Brisco
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,765,638 A 6/1998 Taylor
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.

5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,276,450 B1 8/2001 Seneviratne
6,279,654 B1 8/2001 Mosing et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,334,376 B1 1/2002 Torres
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 * 5/2002 Mullins ..... 166/90.1
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,433,241 B2 9/2002 Juhasz et al.
6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,497,280 B2 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,543,552 B1 4/2003 Metcalfe et al.
6,547,017 B1 4/2003 Vail, III
6,553,825 B1 4/2003 Boyd
6,554,064 B1 4/2003 Restarick et al.
6,585,040 B2 7/2003 Hanton et al.
6,591,471 B1 7/2003 Hollingsworth et al.
6,595,288 B2 7/2003 Mosing et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,040 B1 3/2004 Sensenig
6,708,769 B2 3/2004 Haugen et al.
6,715,430 B2 4/2004 Choi et al.
6,719,071 B1 4/2004 Moyes
6,725,924 B2 4/2004 Davidson et al.
6,725,938 B1 4/2004 Pietras
6,732,822 B2 5/2004 Slack et al.
6,742,584 B1 6/2004 Appleton
6,742,596 B2 6/2004 Haugen
6,742,606 B2 6/2004 Metcalfe et al.

| | | | |
|---|---|---|---|
| 6,745,834 | B2 | 6/2004 | Davis et al. |
| 6,752,211 | B2 | 6/2004 | Dewey et al. |
| 6,776,233 | B2 | 8/2004 | Meehan |
| 6,832,656 | B2 | 12/2004 | Cameron |
| 6,832,658 | B2 | 12/2004 | Keast |
| 6,837,313 | B2 | 1/2005 | Hosie et al. |
| 6,840,322 | B2 | 1/2005 | Haynes |
| 6,848,517 | B2 | 2/2005 | Wardley |
| 6,854,533 | B2 | 2/2005 | Galloway |
| 6,857,486 | B2 | 2/2005 | Chitwood et al. |
| 6,857,487 | B2 | 2/2005 | Galloway |
| 6,868,906 | B1 | 3/2005 | Wail, III et al. |
| 6,877,553 | B2 | 4/2005 | Cameron |
| 6,892,835 | B2 | 5/2005 | Shahin et al. |
| 6,896,075 | B2 | 5/2005 | Haugen et al. |
| 6,899,186 | B2 | 5/2005 | Galloway et al. |
| 6,899,772 | B1 | 5/2005 | Buytaert et al. |
| 6,907,934 | B2 | 6/2005 | Kauffman et al. |
| 6,976,298 | B1 * | 12/2005 | Pietras ..... 29/428 |
| 7,004,259 | B2 * | 2/2006 | Pietras ..... 166/379 |
| 7,096,977 | B2 | 8/2006 | Juhasz et al. |
| 7,100,698 | B2 | 9/2006 | Kracik et al. |
| 2001/0000101 | A1 | 4/2001 | Lovato et al. |
| 2001/0002626 | A1 | 6/2001 | Frank et al. |
| 2001/0013412 | A1 | 8/2001 | Tubel |
| 2001/0040054 | A1 | 11/2001 | Haugen et al. |
| 2001/0042625 | A1 | 11/2001 | Appleton |
| 2001/0047883 | A1 | 12/2001 | Hanton et al. |
| 2002/0029878 | A1 | 3/2002 | Victor |
| 2002/0040787 | A1 | 4/2002 | Cook et al. |
| 2002/0066556 | A1 | 6/2002 | Goode et al. |
| 2002/0074127 | A1 | 6/2002 | Birckhead et al. |
| 2002/0074132 | A1 | 6/2002 | Juhasz et al. |
| 2002/0079102 | A1 | 6/2002 | Dewey et al. |
| 2002/0108748 | A1 | 8/2002 | Keyes |
| 2002/0108758 | A1 | 8/2002 | Keyes |
| 2002/0134555 | A1 | 9/2002 | Allen et al. |
| 2002/0157829 | A1 | 10/2002 | Davis et al. |
| 2002/0162690 | A1 | 11/2002 | Hanton et al. |
| 2002/0170720 | A1 | 11/2002 | Haugen |
| 2002/0189806 | A1 | 12/2002 | Davidson et al. |
| 2002/0189863 | A1 | 12/2002 | Wardley |
| 2003/0029641 | A1 | 2/2003 | Meehan |
| 2003/0034177 | A1 | 2/2003 | Chitwood et al. |
| 2003/0056947 | A1 | 3/2003 | Cameron |
| 2003/0056991 | A1 | 3/2003 | Hahn et al. |
| 2003/0070841 | A1 | 4/2003 | Merecka et al. |
| 2003/0070842 | A1 | 4/2003 | Bailey et al. |
| 2003/0111267 | A1 | 6/2003 | Pia |
| 2003/0141111 | A1 | 7/2003 | Pia |
| 2003/0146023 | A1 | 8/2003 | Pia |
| 2003/0155159 | A1 | 8/2003 | Slack et al. |
| 2003/0164250 | A1 | 9/2003 | Wardley |
| 2003/0164251 | A1 | 9/2003 | Tulloch |
| 2003/0164276 | A1 | 9/2003 | Snider et al. |
| 2003/0173073 | A1 | 9/2003 | Snider et al. |
| 2003/0173090 | A1 | 9/2003 | Cook et al. |
| 2003/0213598 | A1 | 11/2003 | Hughes |
| 2003/0217865 | A1 | 11/2003 | Simpson et al. |
| 2003/0221519 | A1 | 12/2003 | Haugen et al. |
| 2004/0000405 | A1 | 1/2004 | Fournier, Jr. et al. |
| 2004/0003490 | A1 | 1/2004 | Shahin et al. |
| 2004/0003944 | A1 | 1/2004 | Vincent et al. |
| 2004/0011534 | A1 | 1/2004 | Simonds et al. |
| 2004/0016575 | A1 | 1/2004 | Shahin et al. |
| 2004/0060697 | A1 | 4/2004 | Tilton et al. |
| 2004/0069500 | A1 | 4/2004 | Haugen |
| 2004/0069501 | A1 | 4/2004 | Haugen et al. |
| 2004/0079533 | A1 | 4/2004 | Buytaert et al. |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0051343 | A1 | 3/2005 | Pietras et al. |
| 2005/0096846 | A1 | 5/2005 | Koithan et al. |
| 2005/0098352 | A1 | 5/2005 | Beierbach et al. |

FOREIGN PATENT DOCUMENTS

| | | |
|---|---|---|
| CA | 2 335 192 | 11/2001 |
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |

| | | |
|---|---|---|
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| JP | 2001-173349 | 6/2001 |
| RU | 2 079 633 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1618870 | 1/1991 |
| SU | 1808972 | 5/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/01651 | 1/1998 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00/50730 | 8/2000 |
| WO | WO 00/52297 | 9/2000 |
| WO | WO 00/66879 | 11/2000 |
| WO | WO 01/12946 | 2/2001 |
| WO | WO 01/33033 | 5/2001 |
| WO | WO 01/46550 | 6/2001 |
| WO | WO 01/59253 | 8/2001 |
| WO | WO 01/79650 | 10/2001 |
| WO | WO 01/79652 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/44601 | 6/2002 |
| WO | WO 02/081863 | 10/2002 |
| WO | WO 02/086287 | 10/2002 |
| WO | WO 03/006790 | 1/2003 |
| WO | WO 03/074836 | 9/2003 |
| WO | WO 03/087525 | 10/2003 |
| WO | WO 2004/022903 | 3/2004 |
| WO | WO 04/079155 | 9/2004 |

OTHER PUBLICATIONS

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.

M.B. Stone and J. Smith, "Expandable Tubulars and Casing Driling are Options" Drilling Contractor, Jan./Feb. 2002, pp. 52.

M.Gelfgat, "Retractable Bits Development and Application" Transactions of the ASME, vol. 120, Jun. (1998), pp. 124-130.

"First Success with Casing-Drilling" Word Oil, Feb. (1999), pp. 25.

Dean E. Gaddy, Editor, "Russia Shares Technical Know-How with U.S." Oil & Gas Journal, Mar. (1999), pp. 51-52 and 54-56.

U.S. Appl. No. 10/794,800, filed Mar. 5, 2004.

U.S. Appl. No. 10/832,804, filed Apr. 27, 2004.

U.S. Appl. No. 10/795,214, filed Mar. 5, 2004.

U.S. Appl. No. 10/794,795, filed Mar. 5, 2004.

U.S. Appl. No. 10/775,048, filed Feb. 9, 2004.

U.S. Appl. No. 10/772,217, filed Feb. 2, 2004.

U.S. Appl. No. 10/788,976, filed Feb. 27, 2004.

U.S. Appl. No. 10/794,797, filed Mar. 5, 2004.

U.S. Appl. No. 10/767,322, filed Jan. 29, 2004.

U.S. Appl. No. 10/795,129, filed Mar. 5, 2004.

U.S. Appl. No. 10/794,790, filed Mar. 5, 2004.

U.S. Appl. No. 10/162,302, filed Jun. 4, 2004.

Rotary Steerable Technology—Technology Gains Momentum, Oil & Gas Journal, Dec. 28, 1998.

Directional Drilling, M. Mims; World Oil, May 1999, pp. 40-43.

Multilateral Classification System w/Example Applications, Alan MacKenzie & Cliff Hogg, World Oil, Jan. 1999, pp. 55-61.

U.S. Appl. No. 10/618,093.

U.S. Appl. No. 10/189,570.

Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono-Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
PCT Search Report, International Application No. PCT/US2004/006751, dated Oct. 21, 2004.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.

Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
Dennis L. Bickford and Mark J. Mabile, Casing Drilling Rig Selection For Stratton Field, Texas, World Oil, vol. 226 No., Mar. 2005.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.
Coiled Tubing Handbook, World Oil, Gulf Publishing Company, 1993.
U.K. Examination Report, Application No. GB0517928.8, dated Nov. 22, 2005.
PCT and PER, International Application No. PCT/US04/06751, Dated Jun. 6, 2006.
G H. Kamphorst, G. L. Van Wechem, W. Boom, D. Bottger, and K. Koch, Casing Running Tool, SPE/IADC 52770.

* cited by examiner

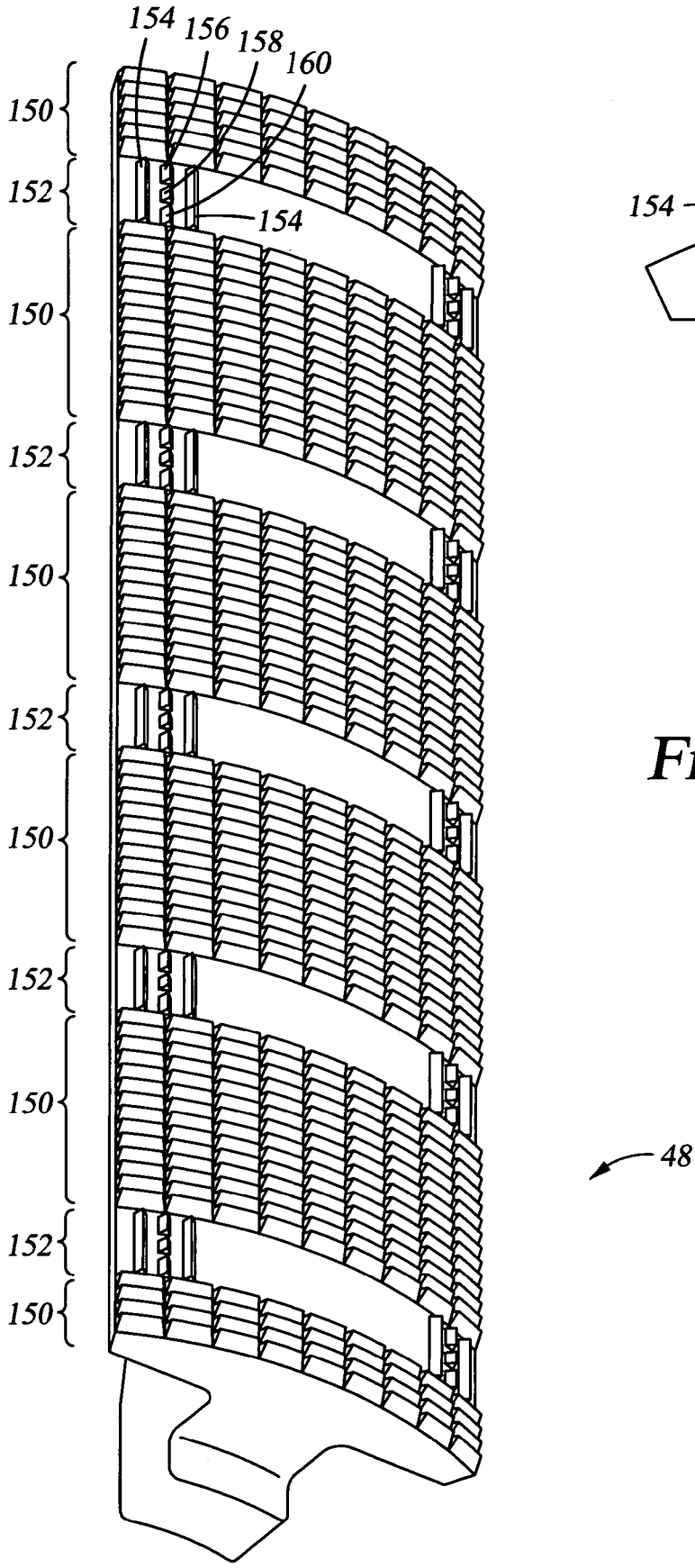
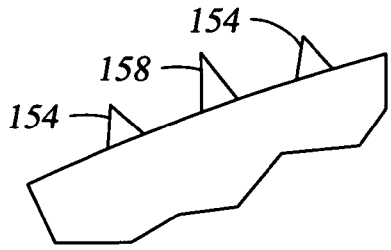
Fig. 8B
Fig. 8A

CASING RUNNING AND DRILLING SYSTEM

CROSS-REFERENCE TO RELATED APPLICATIONS

This application claims benefit of U.S. provisional patent application Ser. No. 60/451,964, filed Mar. 5, 2003, which is herein incorporated by reference.

BACKGROUND OF THE INVENTION

1. Field of the Invention

Embodiments of the present invention generally relate to methods and apparatus useful in the exploration for hydrocarbons located in subsurface formations. More particularly, the invention relates to the use of tubulars, such as casing, and drilling with such casing using a top drive.

2. Description of the Related Art

In the construction of oil and gas wells, it is usually necessary to line the borehole with a string of tubulars, known as casing, which are sequentially threaded together and lowered down a previously drilled borehole. Because of the length of the casing required, sections or stands of two or more individual lengths of casing are progressively added to the string as it is lowered into the well from a drilling platform. To add additional lengths of casing to that already in the borehole, the casing already lowered into the borehole is typically restrained from falling into the well by using a spider located in the floor of the drilling platform. The casing to be added is then moved from a rack to a position above the exposed top of the casing situated in the spider. The threaded pin (male threaded section) of this section or stand of casing to be connected is then lowered over the threaded box (female threaded section) of the end of the casing extending from the well, and the casing to be added is connected to the existing casing in the borehole by rotation therebetween. An elevator is then connected to the top of the new section or stand and the whole casing string is lifted slightly to enable the slips of the spider to be released. The whole casing string, including the added length(s) of casing, is lowered into the borehole until the top of the uppermost section of casing is adjacent to the spider whereupon the slips of the spider are reapplied, the elevator is disconnected and the process repeated.

It is common practice to use a power tong to torque the connection up to a predetermined torque in order to make the connection. The power tong is located on the platform, either on rails, or hung from a derrick on a chain. However, it has recently been proposed to use a top drive for making such connection. A top drive is a top driven rotational system used to rotate the drill string for drilling purposes.

It is also known to use the casing, which is typically only lowered into the borehole after a drill string and drill bit(s) have been used to create the borehole, to actually drive the drill bit to create the borehole, thereby eliminating the need to remove the drill string and then lower the casing into the borehole. This process results in a substantial increase in productivity since the drill string is never removed from the borehole during drilling. To enable this efficiency, the casing is cemented in place once each drill bit or drill shoe reaches its desired or capable depth, and a new drill bit and casing string are lowered through the existing casing to continue drilling into the earth formation. The borehole can be drilled to the desired depth by repeating this pattern.

The use of casing as the rotational drive element to rotate the drill shoe or drill bit in situ has revealed several limitations inherent in the structure of the casing as well as the methodologies used to load and drive the casing. For example, the thread form used in casing connections is more fragile than the connection used in drill pipe, and the casing connections have to remain fluid and pressure tight once the drilling process has been completed. Additionally, casing typically has a thinner wall and is less robust than drill pipe. This is especially true in the thread area at both ends of the casing where there is a corresponding reduction in section area. Furthermore, casing is not manufactured or supplied to the same tolerances as drill string, and thus the actual diameters and the wall thicknesses of the casing may vary from lot to lot of casing. Despite these limitations, casing is being used to drill boreholes effectively.

It is known in the industry to use top drive systems to rotate a casing string to form a borehole. However, in order to drill with casing, most existing top drives require a crossover adapter to connect to the casing. This is because the quill of the top drive is not sized to connect with the threads of the casing. The quill of the top drive is typically designed to connect to a drill pipe, which has a smaller outer diameter than a casing. The crossover adapter is design to alleviate this problem. Typically, one end of the crossover adapter is designed to connect with the quill, while the other end is designed to connect with the casing.

However, the process of connecting and disconnecting a casing is time consuming. For example, each time a new casing is added, the casing string must be disconnected from the crossover adapter. Thereafter, the crossover adapter must be threaded into the new casing before the casing string may be run. Furthermore, this process also increases the likelihood of damage to the threads, thereby increasing the potential for downtime.

More recently, top drive adapters have been developed to facilitate the casing handling operations and to impart torque from the top drive to the casing. Generally, top drive adapters are equipped with gripping members to grippingly engage the casing string to transmit torque applied from the top drive to the casing. Top drive adapters may include an external gripping device such as a torque head or an internal gripping device such as a spear.

The spear typically includes a series of parallel circumferential wickers that grip the casing to help impart rotational or torsional loading thereto. Torque is transferred from the top drive to the spear. Typically, the spear is inserted into the interior of the uppermost length of the string of casing, engaged against the inner circumference of the casing, and turned to rotate the string of casing and drill shoe in the borehole.

When a spear is used for drilling with casing (DwC), the spear is known to damage the interior surfaces of the casing, thereby resulting in raised sharp edges as well as plastic deformation of the casing caused by excessive radial loading of the spear. Scarring or other sources of sharp raised edges interfere with the completion of, and production from, the well formed by the borehole, because rubber, plastic and other readily torn or cut materials are often positioned down the casing to affect the completion and production phases of well life. Further, the ultimate strength of the individual casing joint deformed is reduced if the casing undergoes plastic deformation, and the casing joint may later fail by rupture as it is being used downhole during or after drilling operations. Finally, it is known that the load necessary to grip a string of casing in a well may result in rupture of the casing.

Therefore, there exists a need for a drilling system which enables make up of casing and drilling with casing following make up. Preferably, the drilling system can accommodate variable sizes and weights of casing without causing deformation or rupture of the casing.

SUMMARY OF THE INVENTION

The present invention generally provides method and apparatus for the improved performance of drilling with casing systems, in which the casing is assembled into the drill string and driven by the top drive. Improved loading performance is provided to reduce the incidence of casing deformation and internal damage.

In one aspect, the invention includes a spear having at least one slip element that is selectively engageable against the interior of a casing string with selectable loading. A clamping head is also provided for retrieving and moving a piece of casing into a make up position and then facilitating make up using the rotation from the top drive.

In a further aspect, the slip may include varying wickers, whereby the wickers may be used to change the frictional resistance to slippage of the casing on the spear in response to the approach of a slippage condition. In a still further aspect, the invention may provide a compensation element that is positionable to enable gripping of different diameter casing without deformation. In still another aspect, apparatus are provided for reinforcing the casing to prevent deformation of the casing during engagement of the casing by a spear and drilling with casing operations which follow such engagement.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 8A is a perspective view of a slip having a plurality of wickers disposed thereon.

FIG. 8B is a partial cross-sectional view of vertical wickers disposed on a slip.

DETAILED DESCRIPTION OF THE PREFERRED EMBODIMENT

The present invention generally comprises a casing running and drilling system including a spear or grapple tool and a clamping head integral to a top drive. In at least one embodiment, the axial load of tubular lengths being added to a tubular string is held by the spear at least during drilling, and the torsional load is supplied by the clamping head at least during make up and thereafter by the spear, and alternatively by the spear and/or the clamping head. The clamping head assembly may also be used to position a tubular below the spear in order to enable cooperative engagement of the clamping tool and spear such that the spear inserted into the tubular and the clamping head are mechanically engaged with one another so that torque from the top drive can be imparted to the tubular through the clamping head. Additionally, a casing collar and the clamping head have external support functions to minimize the risk of deforming the tubular when the spear engages the inner diameter (ID) of the tubular.

In a further embodiment, the spear imparts rotary motion to tubulars forming a drilling string, in particular where the tubulars are casing. In a still further aspect, a thickness compensation element is provided to enable the spear to load against the interior of the tubular without risk of deforming the tubular.

Figure 1:
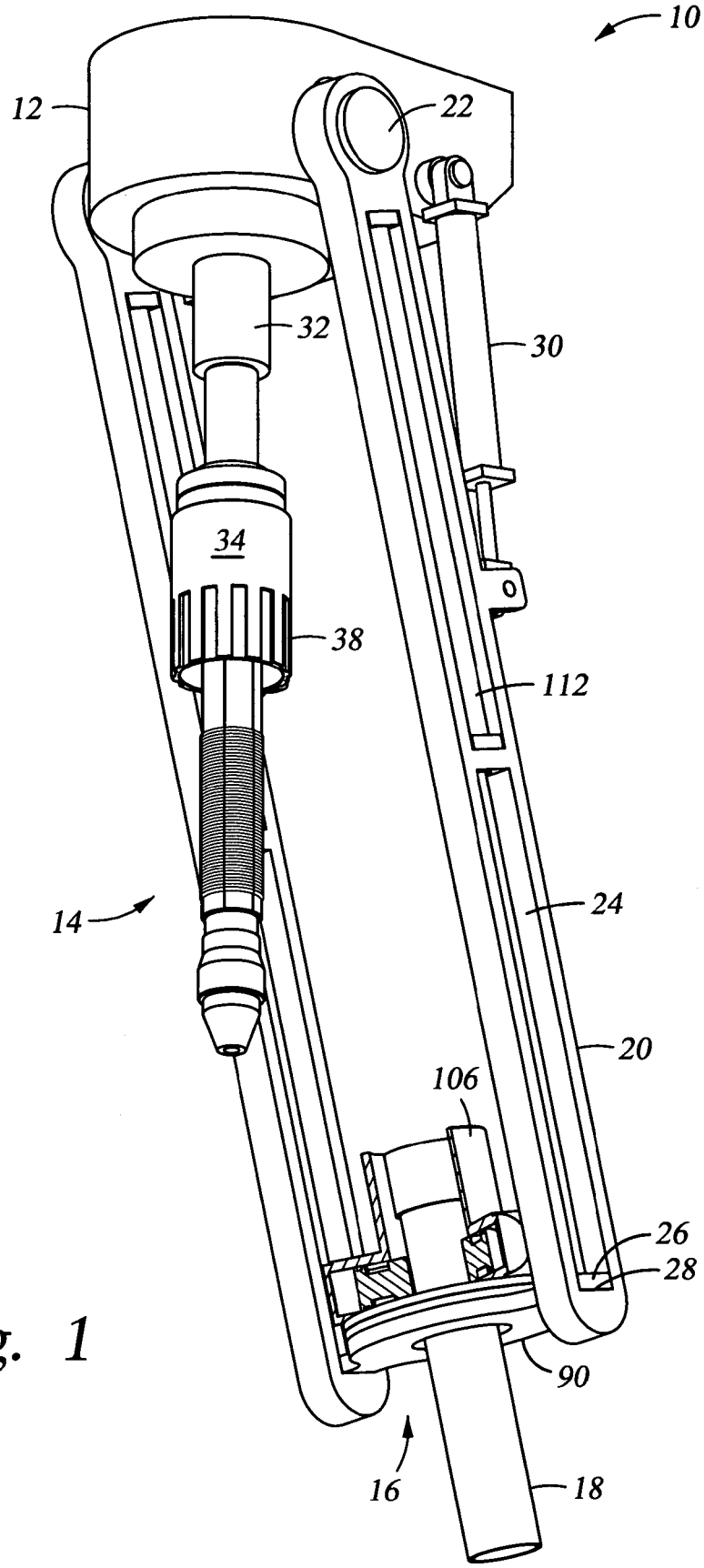
FIG. 1 is a perspective view of one embodiment of a casing running and drilling system.

FIG. 1 is a perspective view illustrating one embodiment of a casing running and drilling system 10 of the invention. The casing running and drilling system 10 includes a top drive 12 suspended on a drilling rig (not shown) above a borehole (not shown), a grapple tool or spear 14 for engagement with the interior of a tubular such as casing 18, and a clamping head 16 engageable with the exterior of the casing 18. In general, the top drive 12 provides rotation to drilling elements connectable therewith.

The clamping head 16 mounts on a pair of mechanical bails 20 suspended from a pair of swivels 22 disposed on the top drive 12. The bails 20 are generally linear segments having axial, longitudinally disposed slots 24 therein. A pair of guides 26 extends from the clamping head 16 into the slots 24 and provides support for the clamping head 16. As shown in FIG. 1, the pair of guides 26 rest against the base 28 of the slots 24 when the clamping head 16 is in a relaxed position. In one embodiment, the guides 26 are adapted to allow the clamping head 16 to pivot relative to the bails 20. Bails 20 further include a pair of bail swivel cylinders 30 connected between the bails 20 and the top drive 12 to swing the bails 20 about the pivot point located at the swivels 22. The bail swivel cylinders 30 may be hydraulic cylinders or any suitable type of fluid operated extendable and retractable cylinders. Upon such swinging motion, the clamping head 16 likewise swings to the side of the connection location and into alignment for accepting or retrieving the casing 18 that is to be added to the string of casing in the borehole.

The spear 14 couples to a drive shaft 32 of the top drive 12 and is positioned between the bails 20 and above the clamping head 16 when the clamping head 16 is in the relaxed position. During make up and drilling operations, the clamping head 16 moves from the position shown in FIG. 1 to the position shown in FIG. 6 such that the spear 14 is in alignment with the casing 18. The spear 14 then enters into the open end of the casing 18 located within the clamping head 16, as shown in detail in FIGS. 2B and 7.

Figure 2A:
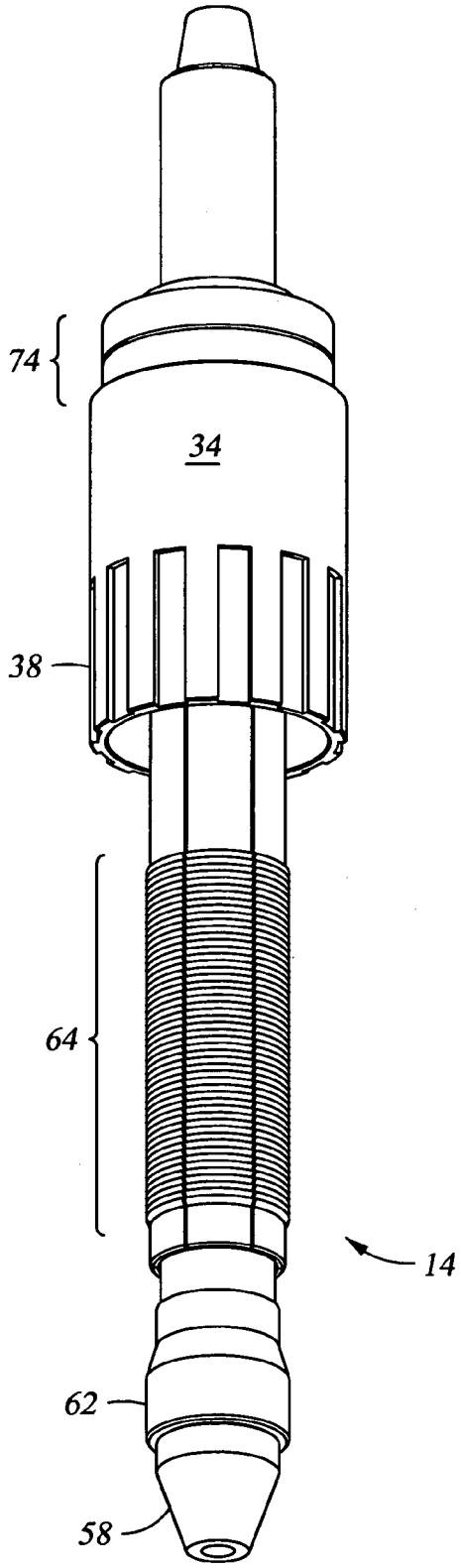
FIG. 2A is a perspective view of one embodiment of a spear.
Figure 2B:
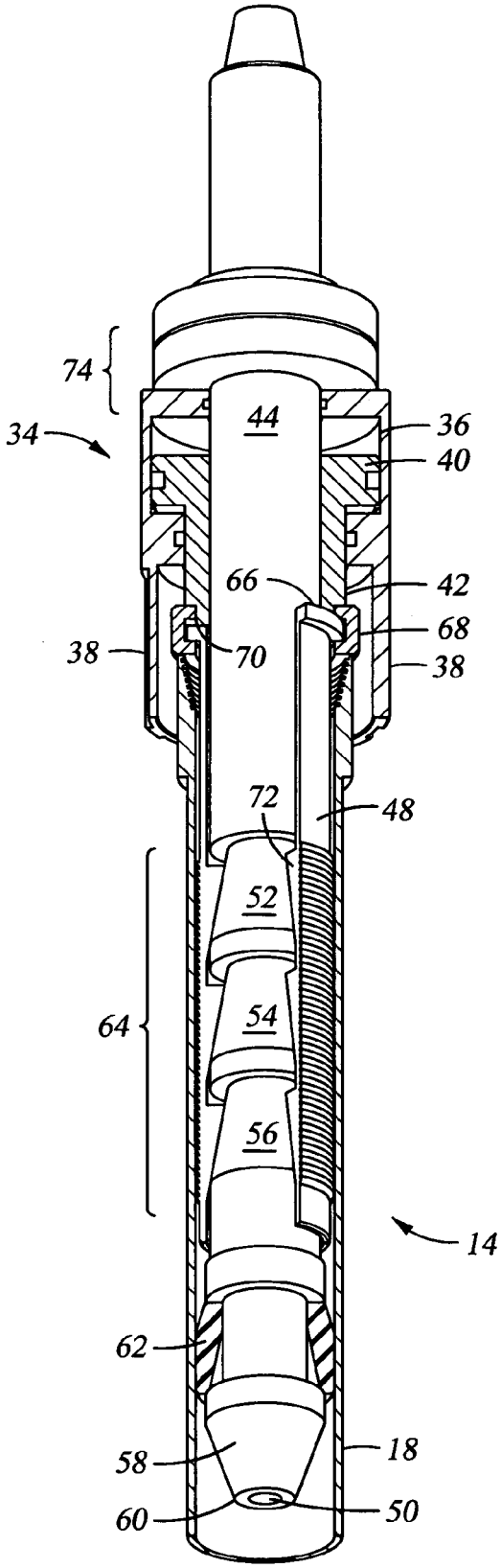
FIG. 2B is a partial sectional view of the spear of FIG. 2A.

FIGS. 2A and 2B show perspective and partial cross-sectional views, respectively, of one embodiment of the spear 14. The spear 14 generally includes: a housing 34 defining a piston cavity 36 and a cup shaped engagement member 38 for engagement with the clamping head 16; a piston 40 disposed within the piston cavity 36 and actuatable therein in response to a pressure differential existing between opposed sides thereof; a slip engagement extension 42 extending from the piston 40 and outwardly of the piston cavity 36 in the direction of the clamping head 16 (shown in FIG. 7); a mandrel 44 extending through the piston cavity 36 and piston 40 disposed therein; and a plurality of slips 48 disposed circumferentially about the mandrel 44 and supported in place by the slip engagement extension 42 and connector 68. The spear 14 enables controlled movement of the slips 48 in a radial direction from and toward the mandrel 44 in order to provide controllable loading of the slips 48 against the interior of the casing 18, as further described herein.

Referring principally to FIG. 2B, the mandrel 44 defines a generally cylindrical member having an integral mud flow passage 50 therethrough and a plurality of conical sections 52, 54, 56 (in this embodiment three conical sections are shown) around which the slips 48 are disposed. A tapered portion 58 at the lower end of the mandrel 44 guides the spear 14 during insertion into the casing 18. An aperture end 60 forms the end of the mud flow passage 50 such that mud or other drilling fluids may be flowed into the hollow interior or bore of the casing 18 for cooling the drill shoe and carrying the cuttings from the drilling face back to the surface through the annulus existing between the casing 18 and borehole during drilling. The spear 14 includes an annular sealing member 62 such as a cap seal disposed on the outer surface of the mandrel 44 between the lowermost conical section 56 and the tapered portion 58. The annular sealing member 62 enables fluid to be pumped into the bore of the casing 18 without coming out of the top of the casing 18.

The mandrel 44 interfaces with the slips 48 to provide the motion and loading of the slips 48 with respect to the casing 18 or other tubular being positioned or driven by the top drive 12. Referring still to FIG. 2B, each of the slips 48 include a generally curved face forming a discrete arc of a cylinder such that the collection of slips 48 disposed about the mandrel 44 forms a cylinder as shown in FIG. 2A. Each slip 48 also includes on its outer arcuate face a plurality of engaging members, which in combination serve to engage against and hold the casing 18 or other tubular when the top drive 12 is engaged to drill with the casing 18. In one embodiment, the engaging members define a generally parallel striations or wickers 64. At the upper end of each slip 48 is an outwardly projecting lip 66, which engages with the slip engagement extension 42 by way of a connector 68. In this embodiment, the connector 68 is a c-shaped flange that couples the slip engagement extension 42 to the slips 48 by receiving the lip 66 of the slips 48 and a generally circumferential lip 70 on the piston extension 42. Thus, the position of the slips 48 relative to the conical sections 52, 54, 56 on the mandrel 44 is directly positioned by the location of the piston 40 in the piston cavity 36. The slips 48 further include a plurality of inwardly sloping ramps 72 on their interior surfaces that are discretely spaced along the inner face of the slips 48 at the same spacing existing between the conical sections 52, 54, 56 on the mandrel 44. Each ramp 72 has a complementary profile to that of the conical sections 52, 54, 56. In a fully retracted position of the slips 48, the greatest diameters of the conical sections 52, 54, 56 are received at the minimum extensions of the ramps 72 from the inner face of the slips 48, and the minimum extensions of the conical sections 52, 54, 56 from the surface of the mandrel 44 are positioned adjacent to the greatest inward extensions of the ramps 72.

Figure 7:
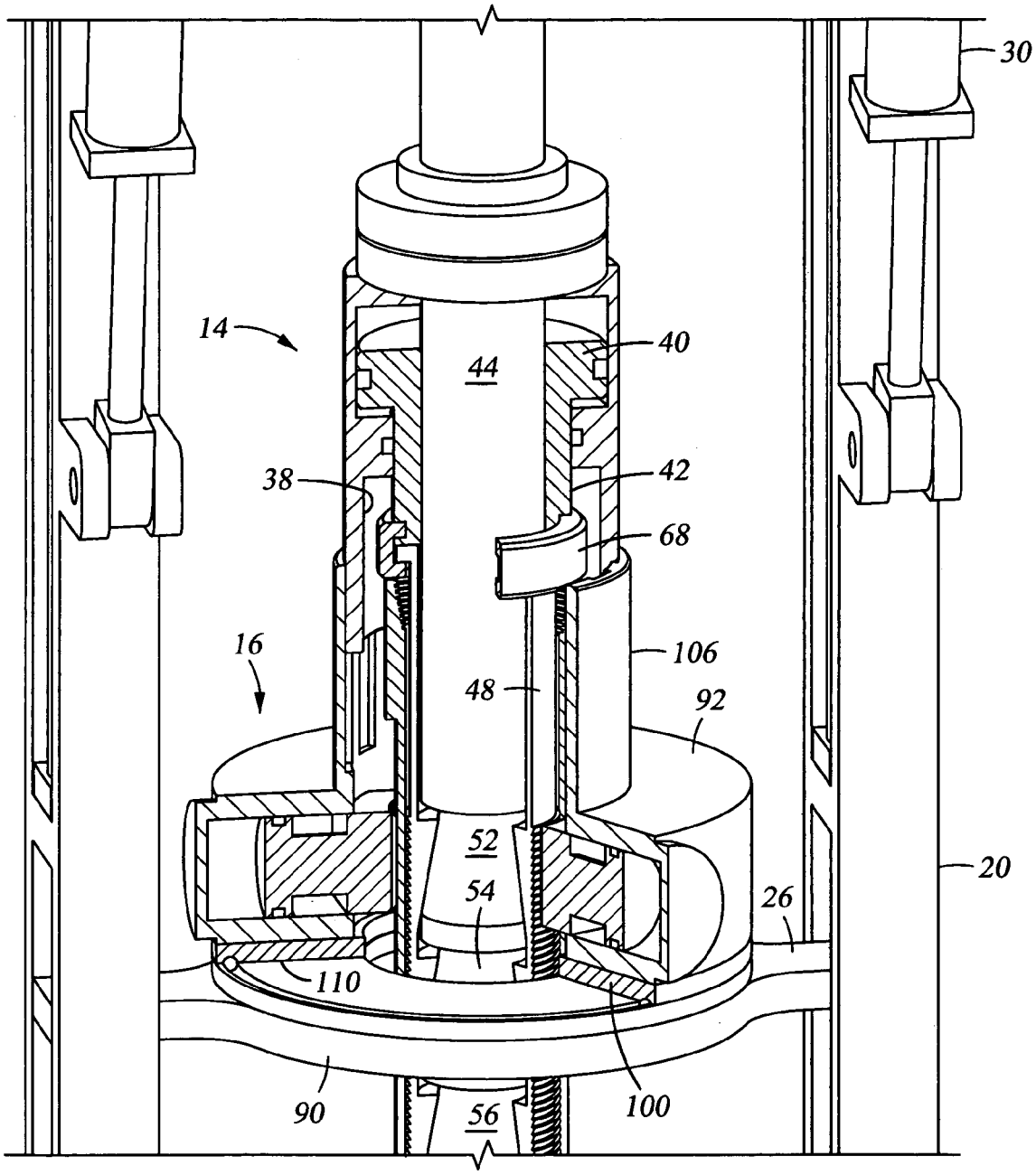
FIG. 7 is a partial sectional view showing the operation of the casing running and drilling system.

To actuate the slips 48 outwardly and engage the inner face of a section of the casing 18, the piston 40 moves downwardly in the piston cavity 36, thereby causing the ramps 72 of the slips 48 to slide along the conical sections 52, 54, 56 of the mandrel 44, thereby pushing the slips 48 radially outwardly in the direction of the casing wall to grip the casing 18 as shown in FIGS. 2B and 7. To actuate the piston 40 within the piston cavity 36, air is supplied thereto through a rotary union 74, which enables the placement of a stationary hose (not shown) to supply the air through the mandrel 44 and into the piston cavity 36 on either side of the piston 40, selectively. By releasing the air from the upper side of the piston 40, and introducing air on the lower side of the piston 40, the slips 48 swing inwardly to the position shown in FIG. 2A. The load placed on the casing 18 by the slips 48 may be controlled to sufficiently grip the casing 18 but not exceed the strength of the casing 18 against plastic deformation or rupture by selectively positioning the piston 40 in the piston cavity 36 based upon known conditions and qualities of the casing 18. Radial force between the slips 48 and the casing 18 may increase when the casing 18 is pulled or its weight applied to the spear 14 since the slips 48 are pulled downwards and subsequently outwards due to the ramps 72 and the conical sections 52, 54, 56.

Figure 4:
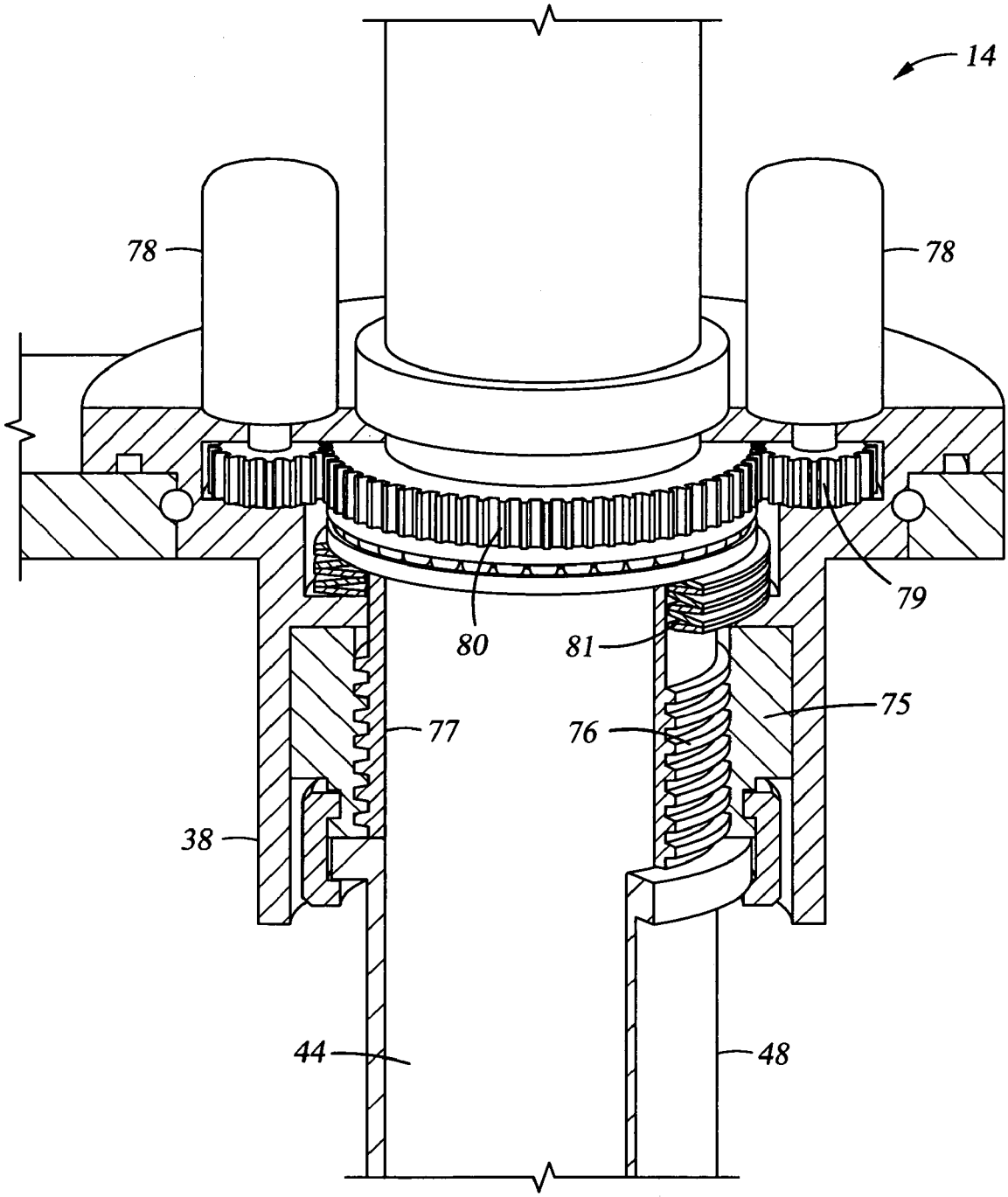
FIG. 4 is a partial sectional view of another embodiment of a spear.

FIG. 4 illustrates an alternative embodiment of a spear 14 that replaces the piston 40 and piston cavity 36 used as an actuator in the embodiment shown in FIG. 2B with a spindle drive in order to provide an actuator that imparts relative movement between slips 48 and mandrel 44. A plurality of threads 76 on a spindle 77 thread into a threaded nut 75 grounded against rotation at a location remote from the conical sections (not shown). By rotating the spindle 77, the threaded nut 75 and the slips 48 coupled thereto may move upwardly or downwardly with respect to the mandrel 44, thereby causing extension or retraction of the slips 48 due to the interactions between ramps 72 and conical sections 52, 54, 56 as described above and illustrated in FIG. 2B. The spindle 77 rotates by activating and controlling spindle drive motors 78. The motors 78 rotate pinions 79 that mesh with a gear 80 of the spindle 77 and provide rotation thereto in order to control the grip that the slips 48 have on the casing (not shown). Springs 81 and relative axial movement between the gear 80 and pinions 79 permit downward movement of the slips 48 when the casing 18 is pulled or its weight applied to the spear 14. In this manner, radial force between the slips 48 and the casing 18 may increase since the slips 48 are pulled downwards and subsequently outwards due to the ramps 72 and the conical sections 52, 54, 56.

Figure 5:
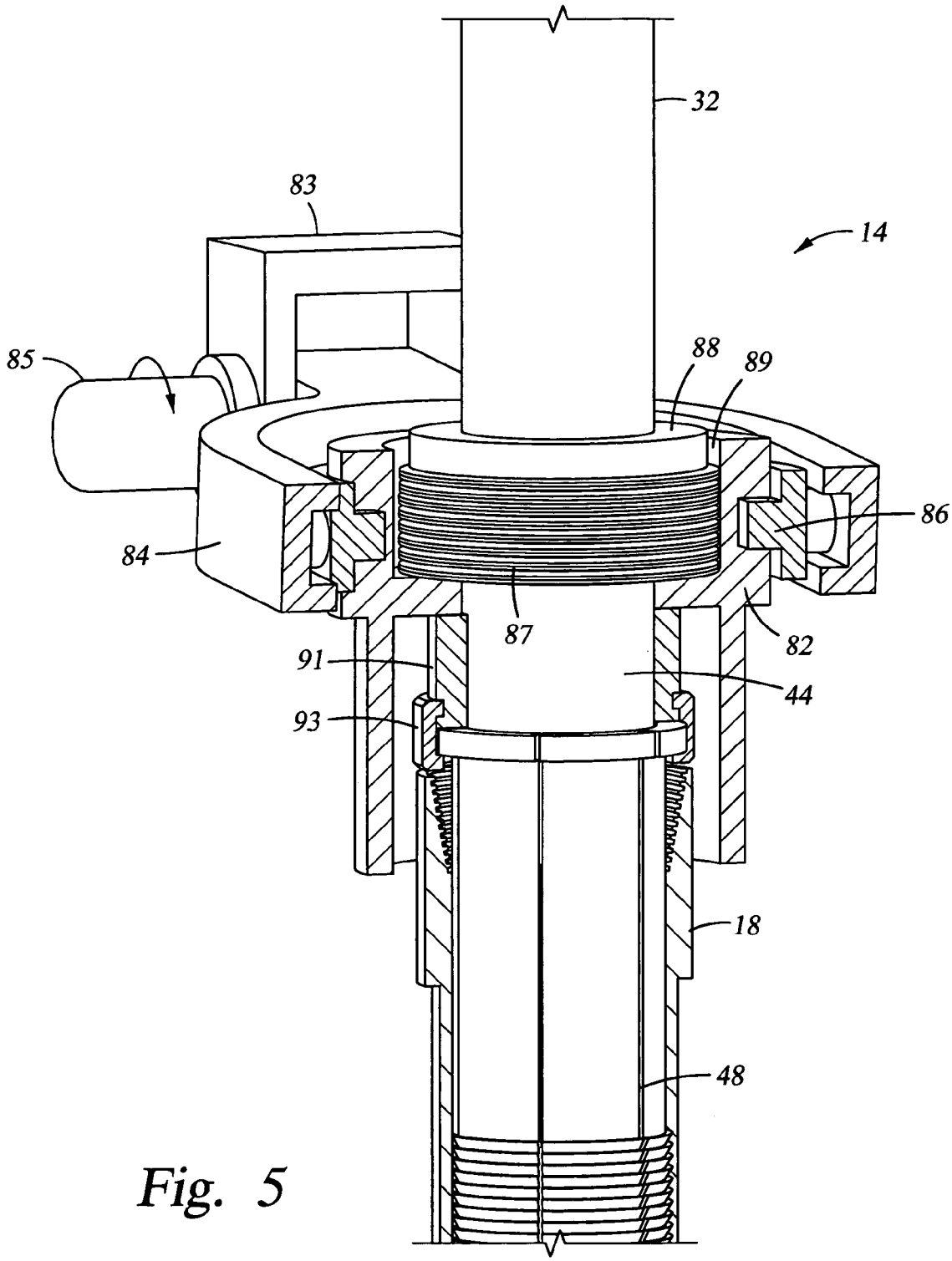
FIG. 5 is a partial sectional view of another embodiment of a spear.

FIG. 5 shows another embodiment of a spear 14 that includes a housing 82 held in a fork lever 84 coupled to a base 83 to provide a swivel. A sliding ring 86 couples the housing 82 to the fork lever 84. The base 83 attaches to a portion of the top drive (not shown) such that movement of the fork lever 84 provides relative movement between a mandrel 44 of the spear 14 connected to the top drive and slips 48 coupled to the fork lever 84. A bushing 91 connected to the slips 48 using a connector 93 is provided to couple the slips 48 and the housing 82. A spring 87 held in a retainer 89 formed above the housing 82 acts on an annular flange 88 of the shaft 32 to bias the slips 48 downward relative to the mandrel 44. A swivel drive 85 positions the fork lever 84 in the swivel position shown in FIG. 5 such that the spring 87 urges the slips 48 downward with respect to the mandrel 44, thereby causing loading of the slips 48 against the interior of the casing 18 as ramps 72 on the inside of the slips 48 engage against conical sections 52, 54, 56 of the mandrel 44 as described above and illustrated in FIG. 2B. If the swivel drive 85 actuates in the direction opposite of the arrow, then the spring 87 compresses against the annular flange 88 due to the fork lever 84 and housing 82 being raised relative to the mandrel 44. Raising the housing 82 also raises the slips 48 coupled thereto relative to the mandrel 44 in order to allow the slips 48 to slide inwardly. Therefore, the swivel drive 85 operates as another example of an actuator used to engage and disengage the slips 48.

Figure 3:
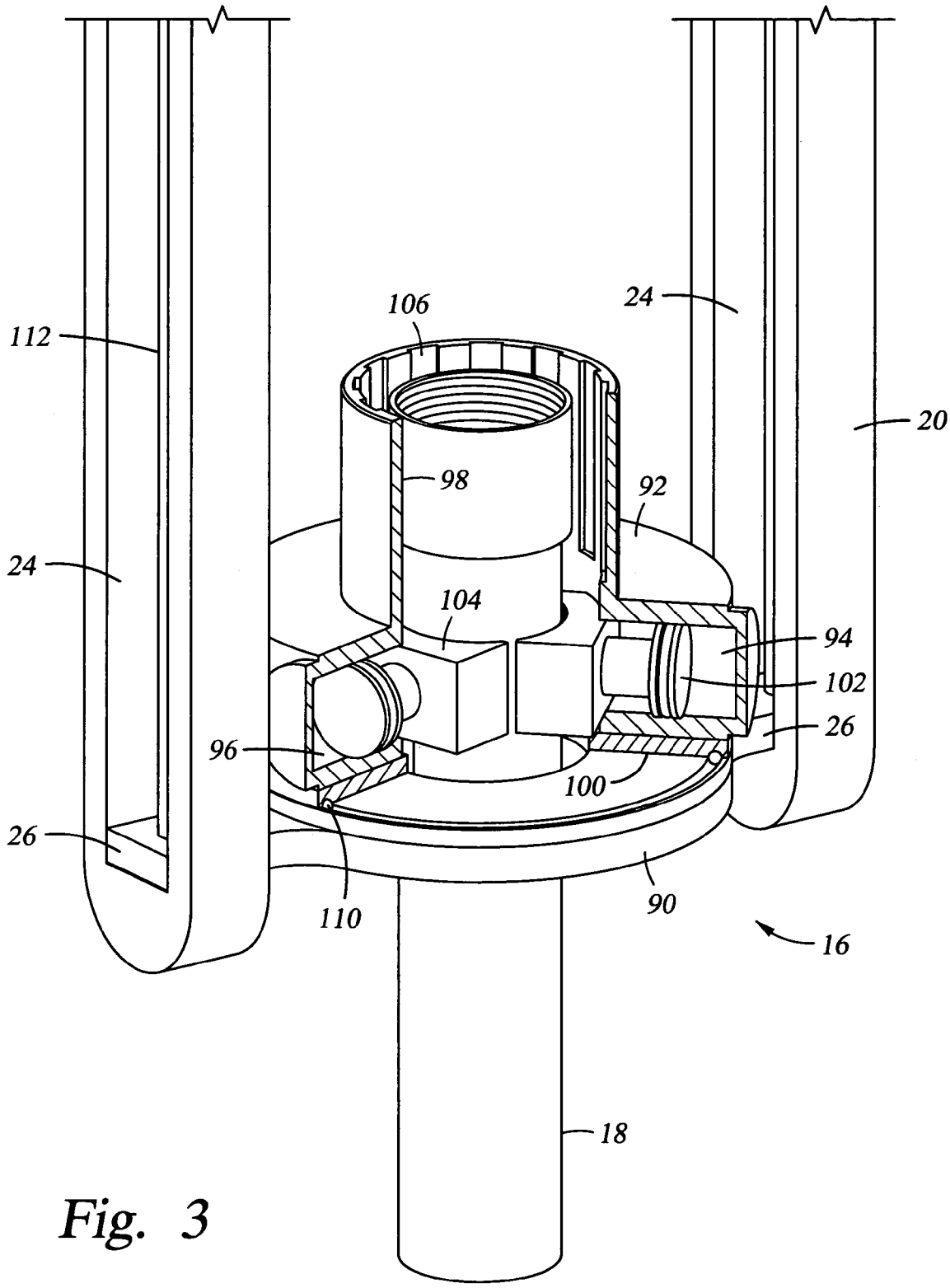
FIG. 3 is a partial sectional view of one embodiment of a clamping head.

FIG. 3 illustrates a partial sectional view of the clamping head 16 shown in FIGS. 1 and 7. The clamping head 16 generally includes a clamping head carrier 90 upon which a housing 92 of the clamping head 16 is positioned for rotation therewith. A bearing face 100 and a bearing 110 enable rotation of the housing 92 on the carrier 90. The clamping head carrier 90 includes the two guides 26 which extend into the slots 24 in the opposed bails 20. Within the slots 24 in the bails 20 are positioned lifting cylinders 112, one end of which are connected to the guides 26 and the second end of which are grounded within the bails 20, to axially move the clamping head assembly 16 along the bails 20.

The clamping head housing 92 includes a plurality of hydraulic cylinders 94, 96, preferably three (two are shown), disposed about and radially actuatable toward the centerline of a tubular receipt bore 98 into which pipe, casing 18 and the like may be selectively positioned. Hydraulic pistons 102, 104 disposed within the hydraulic cylinder cavities 94, 96 move inward in a radial direction toward the axis of the casing 18 and clamp the casing 18 therein. In this manner, the hydraulic pistons 102, 104 are hydraulically or pneumatically actuatable within the cylinders 94, 96 to engage or release the casing 18 positioned in the receipt bore 98. Hydraulic or pneumatic pressure may be transmitted to the cylinders 94, 96 using a rotary union (not shown) similar to the rotary union 74 of the spear 14. The upper end of the housing 92 of the clamping head 16 includes a female splined portion 106 which mates with a male splined portion of the cup shaped engagement member 38 (shown in FIG. 1). The engagement between the female splined portion 106 of the clamping head 16 and the cup shaped engagement member 38 of the spear 14 allows torque transfer from the spear 14 to the clamping housing 92 such that the clamping housing 92 that grips the casing 18 rotates on top of the clamping head carrier 90 during rotation of the spear 14.

Figure 6:
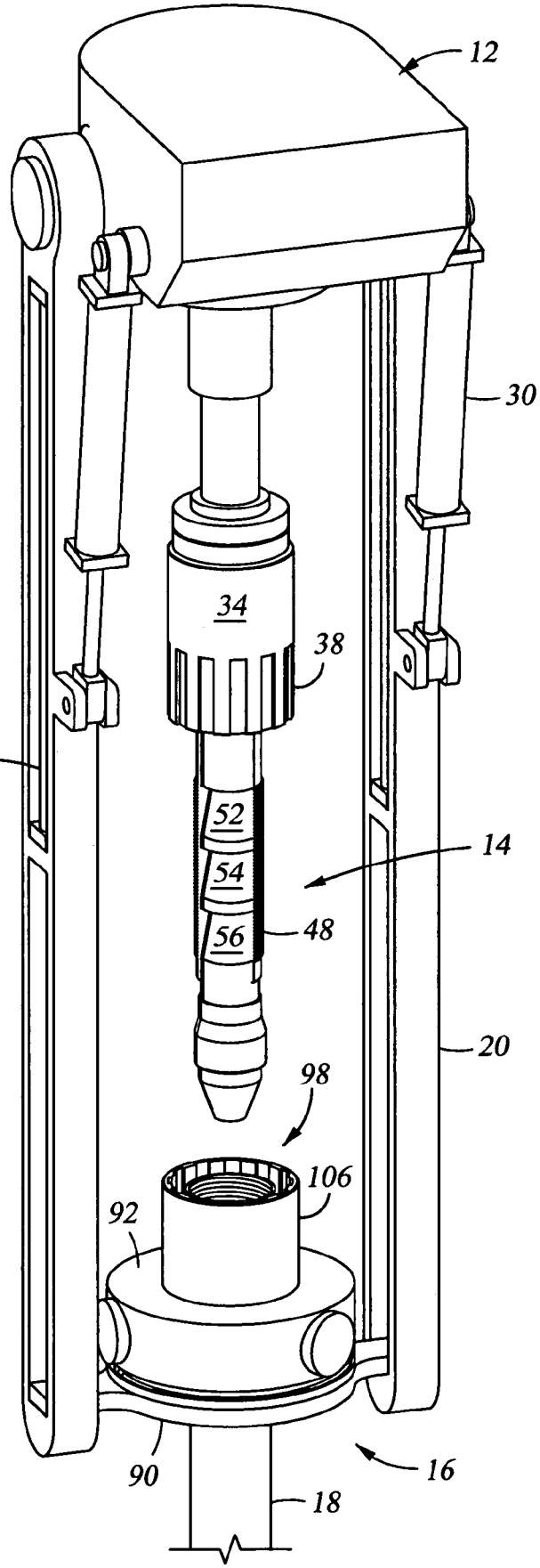
FIG. 6 is a perspective view showing the alignment of a casing under a spear supported by a clamping head.
Figure 6A:
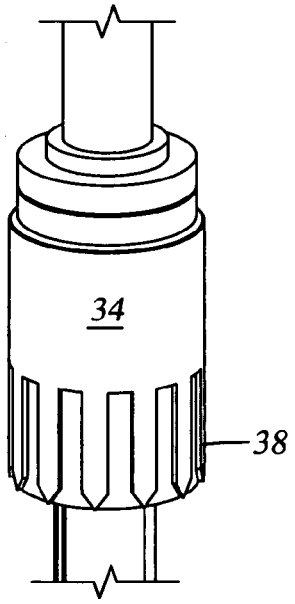
FIG. 6A is a partial view of one embodiment of a spline for an engagement member of a spear.

To begin a make up operation, the bails 20 are positioned as shown in FIG. 1 by the bail swivel cylinders 30. The clamping head 16 is open, i.e., the hydraulic pistons 102, 104 are retracted and the clamping head 16 is generally near its lowest position within the bails 20. With the clamping head 16 in the open position, the casing 18 can be fed from the rig's v-door (not shown). Once the casing 18 is inserted into the clamping head 16, the pistons 102, 104 of the clamping head 16 are extended to engage the casing 18. While not shown, the positioning of the casing 18 into the clamping head 16 can be performed by positioners and the positioning thereof can be monitored by means of sensors (mechanical, electrical or pneumatic sensors). Next, the bail swivel cylinders 30 actuate to position the bails 20 and the casing 18 in vertical alignment with the top drive 12 and the spear 14 as shown in FIG. 6. Actuating the lifting cylinders 112 raises the clamping head 16 and the casing 18 until the splined portion 106 of the clamping head 16 engages with the mating splines of the engagement member 38 as shown in FIG. 7. To aid in the insertion, the leading ends of the splines may be cut in a generally helical manner to affect the rotational alignment of the mating splines without the need for rotation of the spear 14, as shown in FIG. 6A. The entire top drive 12 is then lowered downwardly until the pin end of the casing 18 is close to the box of the casing string fixed in the spider on the rig floor (not shown). As the pin end of the casing 18 approaches the box of the casing string below, the top drive 12 stops its downward travel and the clamping head 16 and the casing 18 is lowered downward by actuating the lifting cylinders 112 while the drive shaft 32 of the top drive 12 rotates the spear 14, the clamping head 16 engaged with the spear 14, and the casing 18 gripped by the clamping head 16. In this manner, the pin end of the casing 18 stabs into the box of the casing string. After stabbing, the top drive 12 makes up the threaded connection to the necessary torque. To facilitate torque transmission, the tubular contact surface of the pistons 102, 104 may include wickers, teeth, or gripping members. During the make up operation, the lifting cylinders 112 move the clamping head 16 downwardly to compensate for the axial movement of the casing 18 caused by the make-up of the threaded connection. Thus, a preset force (pressure) applied by the lifting cylinders 112 to the clamping head 16 protects the threads of the connection from overloading. The pistons 102, 104 of the clamping head 16 release the casing 18 after the connection is made up.

Thereafter, the spear 14 is actuated to push the slips 48 down and cause the slips 48 to clamp the casing 18 from the inside. Once the spear 14 clamps the inside of the casing 18, the top drive 12 carries the weight of the newly extended casing string and lifts the casing string up relative to the spider (not shown), thereby releasing the casing string from the spider. After the casing string is released from the spider, the top drive 12 moves down and drilling with the casing commences. During drilling, the slips 48 of the spear 14 continue to grip the inside of the casing 18 to support the load and any torsional force from drilling as necessary.

In some drilling operations, it may be necessary to set the casing string under pressure while drilling. To this end, the present invention provides one or more ways to transfer pressure from the top drive 12 to the casing 18. In one aspect, the clamping head 16 may be used to clamp the casing 18 and transfer a thrust/rotational load to the casing drill string. Rotation load is provided by the top drive 12 to the casing string due to the spline engagement between the clamping head 16 and the cup shaped engagement member 38 of the spear 14. From this configuration, the thrust load may be supplied to the casing 18 either from the top drive 12 or the lifting cylinders 112. In one embodiment, the top drive 12 supplies the thrust load, which is transferred to the engagement member 38, to the clamping head 16, and then to the casing 18 clamped therein. Alternatively, the thrust load may be supplied by the lifting cylinders 112 pushing the clamping head 16 downward along the slots 24 in the bails 20.

Figure 7A:
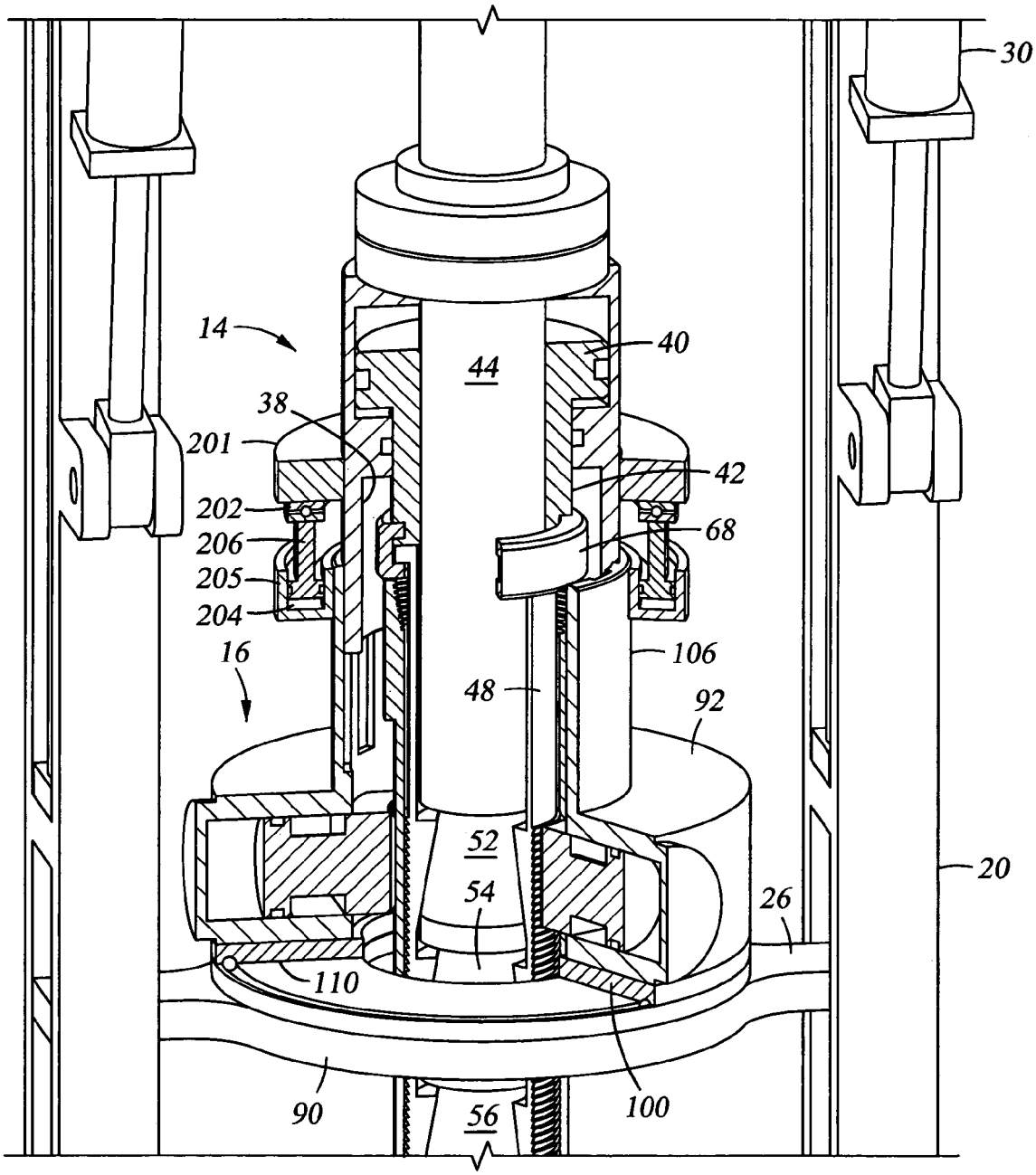
FIG. 7A shows another embodiment of a casing running and drilling system.

In another embodiment still, the thrust load may be applied by placing a separating force between male and female splined cups, as shown in FIG. 7A. In FIG. 7A, the upper cup includes a shoulder 201 and the bottom cup includes a shoulder 205 with a plurality of pistons 206 attached thereto. The pistons 206 contract or extend based on applied pressure in the cavity 204. As the pistons 206 are extended, the thrust bearing 202 attached to the piston 206 comes into contact with a lower surface of the shoulder 201. With increased pressure in cavity 204 the applied force on the lower surface is increased. This load is transmitted through to the mandrel 44 and the casing 18 thereby holding the spear 14 in position.

Although embodiments of the present invention disclose a hydraulic or fluid operated spear, aspects of the present invention are equally applicable to a mechanically operated spear. In this respect, the mechanical spear may be adapted for use in compression without releasing the casing.

In another embodiment, the spear may optionally include a valve for filling up and circulating fluid in the casing. An exemplary valve is disclosed in U.S. Patent Application Publication No. 2004/0000405, filed on Jun. 26, 2002, which application is assigned to the same assignee of the present application. In one example, the valve may include a valve body and a valve member disposed in the valve body. The valve member is movable between an open and closed position and includes an aperture therethrough. The valve further includes a pressure relief member disposed in the aperture, whereby at a predetermined pressure, the pressure relief member will permit fluid communication.

The spear of the present invention may be configured for specific utility to enable the capture of casing of variable geometry and size, from large casing used at the beginning of drilling down to relatively small diameter casing, with a single set of slips, which was not practical in the prior art. In particular, where the casing is used for drilling, substantial weight must be suspended from the slips, such weight comprising the accumulated effective weight of several thousand feet of casing suspended in the borehole, less any buoyancy offset caused by the presence of drilling fluids in the borehole. Where a single set of slips is used for casing of different specified diameters, the slips have only a set area over which they may engage the casing, such that as the casing becomes larger in diameter, and thus correspondingly heavier, the unit of mass per unit area of slip increases significantly. In the prior art, this was compensated for by increasing the load of the slips on the casing, resulting in scarring of the casing surface and/or plastic deformation or rupture of the casing.

Figure 9:
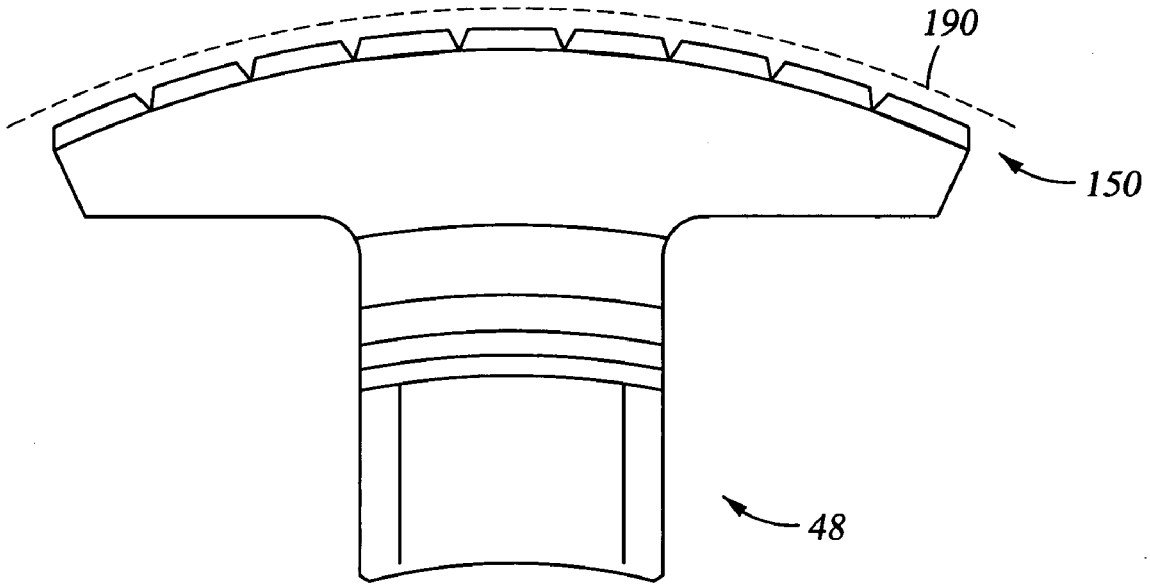
FIG. 9 is a cross-sectional view of a slip having wickers disposed thereon and positioned in casing of variable inner diameter.
Figure 10A:
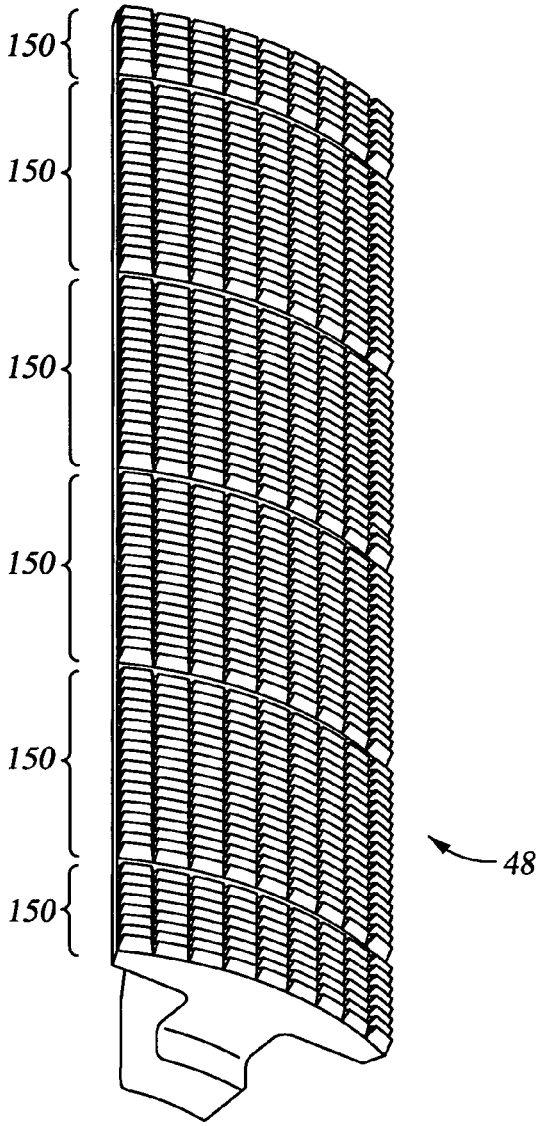
FIGS. 10A and 10B are perspective and cross-sectional views, respectively, of a slip having variable height wickers disposed thereon, with higher wickers disposed on the outer edges of the slip.
Figure 10C:
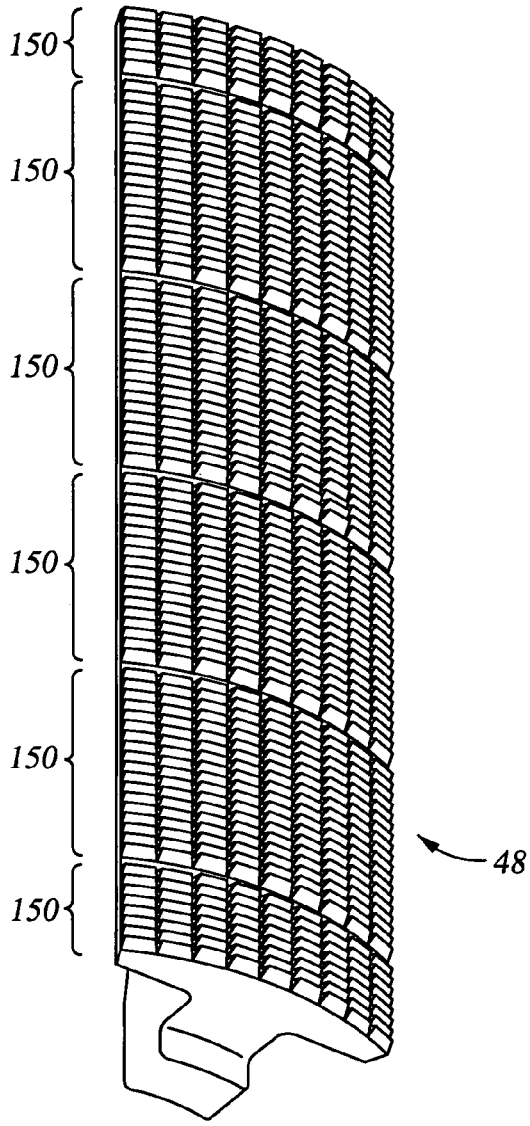
FIGS. 10C and 10D are perspective and cross-sectional views, respectively, of a slip having variable height wickers disposed thereon, with higher wickers disposed on the center of the slip.

FIGS. 8A, 10A and 10C are perspective views of slips 48 having wickers 150 disposed thereon. The axial load is distributed among a plurality of wickers 150, each of which includes a crest portion which is engageable against the casing surface. The crest portion includes a relatively sharp edge which is engageable through the scale or rust typically found on the inner surface of the casing 18. In one aspect, the wickers 150 are configured, as shown in profile in FIGS. 8B, 9, 10B and 10D, to include crest portions located various heights. In this respect, where the load is less, fewer wicker crest portions are engaged to carry the load. As the outward load increases, more wicker crest portions are recruited to support the load. FIG. 9 shows a dashed arc 190 representing the potential variation in height of wickers 150 across the face of the slip 48. By having wickers 150 with crest portions at multiple heights from the face of the slips 48, a spear 14 may be equipped with a single set of slips 48 to load and drill with casing 18 of a variety of sizes without overloading or tearing into the circumferential inner face of the casing 18.

FIG. 8A optionally includes vertical wickers 152 of variable lengths and heights. Generally, the wickers 152 are configured to include a crest portion positioned exteriorly of, and spaced from, the outer surface of the slips 48. In the embodiment shown in FIG. 8A, the slip 48 includes two outer full length wickers 154 surrounding three shorter length wickers 156, 158, 160 disposed therebetween. The wickers 156, 158, 160 in the center may have a height slightly greater than that of the outer wickers 154. Depending on the applied load, the number of wickers 152 recruited for duty may be varied. For example, only the center wickers 156, 158, 160 may be engaged for smaller loads, while all the wickers 152 may be recruited for heavier loads.

Figure 10B:
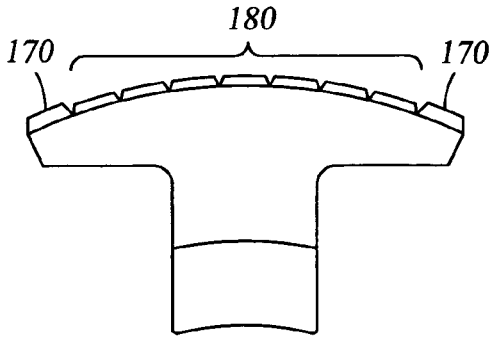
Figure 10D:
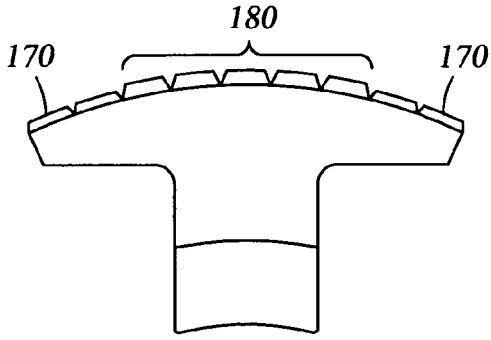

Referring now to FIGS. 10A–10D, there is shown a plurality of wickers 150 having variable height. As shown in FIGS. 10A and 10B, the height of the outer column of wickers 170 is slightly greater than the inner columns of wickers 180. In FIGS. 10C and 10D, the inner columns of wickers 180 have a height slightly greater than the outer columns of wickers 170. The arrangement of slips 48 within a single tool may include the same wicker configuration for each slip 48 or may include slips 48 varying between two or more different wicker configurations. As an example, the tool may include slips 48 having the configuration of either FIG. 8A, 10A or 10C. Alternatively, the tool may include slips 48 of FIGS. 10A and 10C. Still further, the tool may include slips 48 of FIGS. 8A, 10A and 10C, or any combination of these or other designs.

Figure 11:
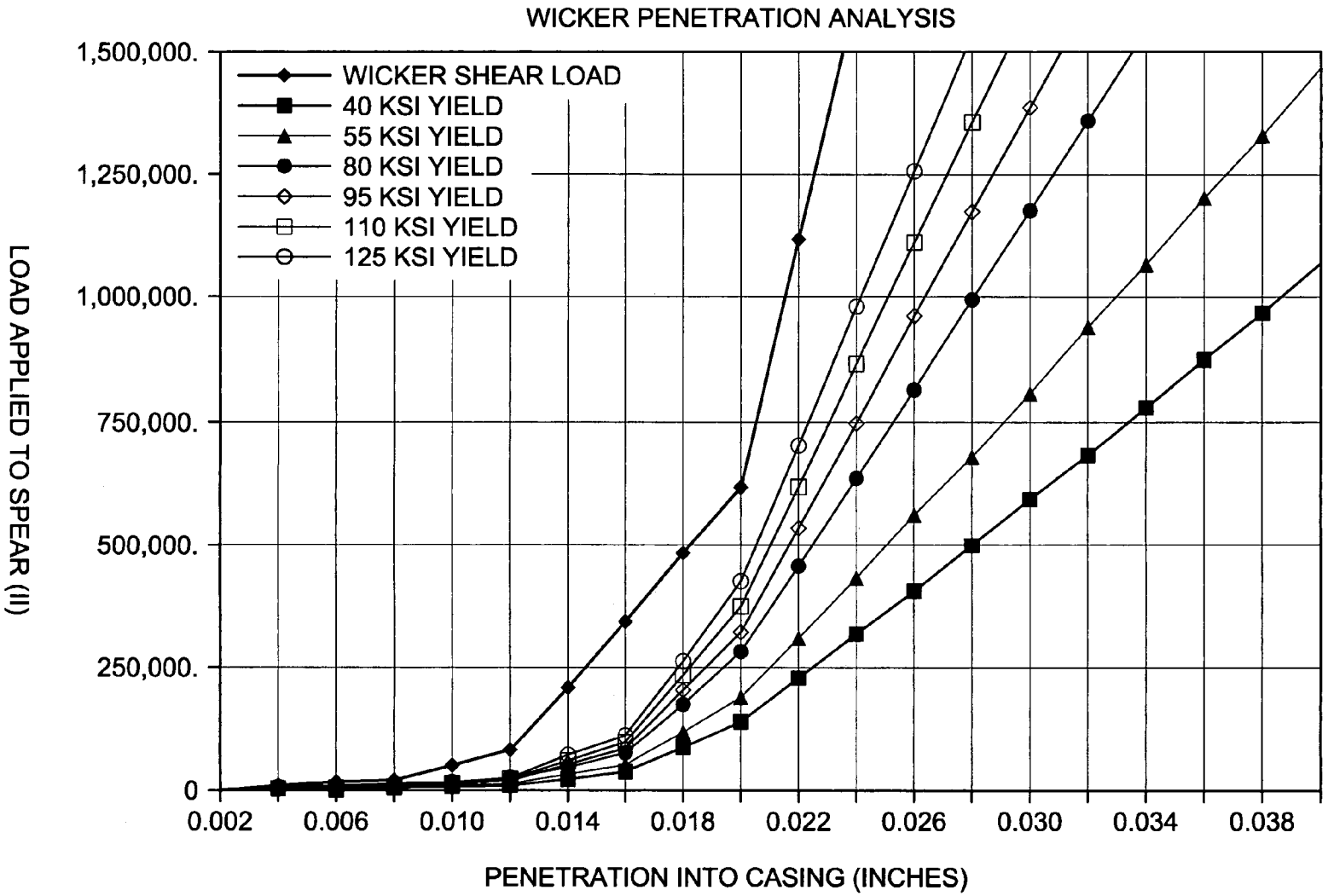
FIG. 11 is a graph comparing the load required to penetrate various grades of casing and load to shear out the casing versus the actual penetration depth resulting from applied load.

Referring back to FIGS. 10A and 10C, while only two varying heights are shown, more wickers 150 of variable heights are contemplated herein. As an example, the first wicker may be of a height H, extending between the base of the wicker plate or the base of the slip loading face, and terminating in a generally sharp edge. The second wicker may be have a height on the order of 80% of H, the third wicker may have a height on the order of 75% of H, etc. Thus, when the slips are biased against the casing inner surface, the wicker of the first height H will engage the casing and penetrate the surface to secure the casing in place. If the casing begins to move relative to the slips 48, the relative movement will cause the first wicker to penetrate deeper into the casing until the wickers of the second height engage against the inner face of the casing to provide additional support. In this respect, capacity to retain the casing may be increased without increasing the pressure on the casing. The wickers will rapidly establish a stable engagement depth, after which further wicker engagement is unlikely. Preferably, the wickers are distributed in height throughout the slip, both in the individual striations, as well as the wickers on the wicker plate, to enable relatively fast equilibrium of wicker application. As the number of wickers increases, the collective wicker shear load is designed to stay below the load required to shear any number of wickers that has penetrated the highest yield strength casing. This is graphically represented in FIG. 11.

Referring again to FIG. 8, the wickers 150, 152 on the wicker plates are located intermediate individual sets of striations and generally perpendicular thereto, and are generally evenly spaced circumferentially across the face of the slip 48 in the gaps between adjacent sets of striations. The wickers 150, 152 may vary in height in multiple positions as described above in reference to FIGS. 10A–10D. Preferably, the tallest wickers are located toward, but not at the edge of the slip 48 as shown in FIG. 9, with correspondingly shorter wickers located circumferentially inwardly and outwardly therefrom. As a result, whether the casing is smaller in diameter or larger in diameter from the nominal design size, the same tallest wickers will engage the casing.

In this manner, aspects of the present invention provide a spear with increased capacity to carry more casing weight with minimal or no damage to the casing or slips. In one embodiment, the capacity may be increased without the use of hydraulics. Because the wickers vary in height and quantity, they penetrate a variety of casing IDs with the same applied load from the casing to the same depth. The wickers may function with or without the presence of scale. In one aspect, the load required to penetrate various grades of casing is designed to remain below the load to shear out the casing by accounting for the actual penetration depth resulting from any applied load. It must be noted that aspects of the present invention may apply to any gripping tool, mechanical or hydraulic, such as a spear, torque head, overshot, slip, tongs, or other tool having wickers or teeth as is known to a person of ordinary skill in the art.

Figure 12:
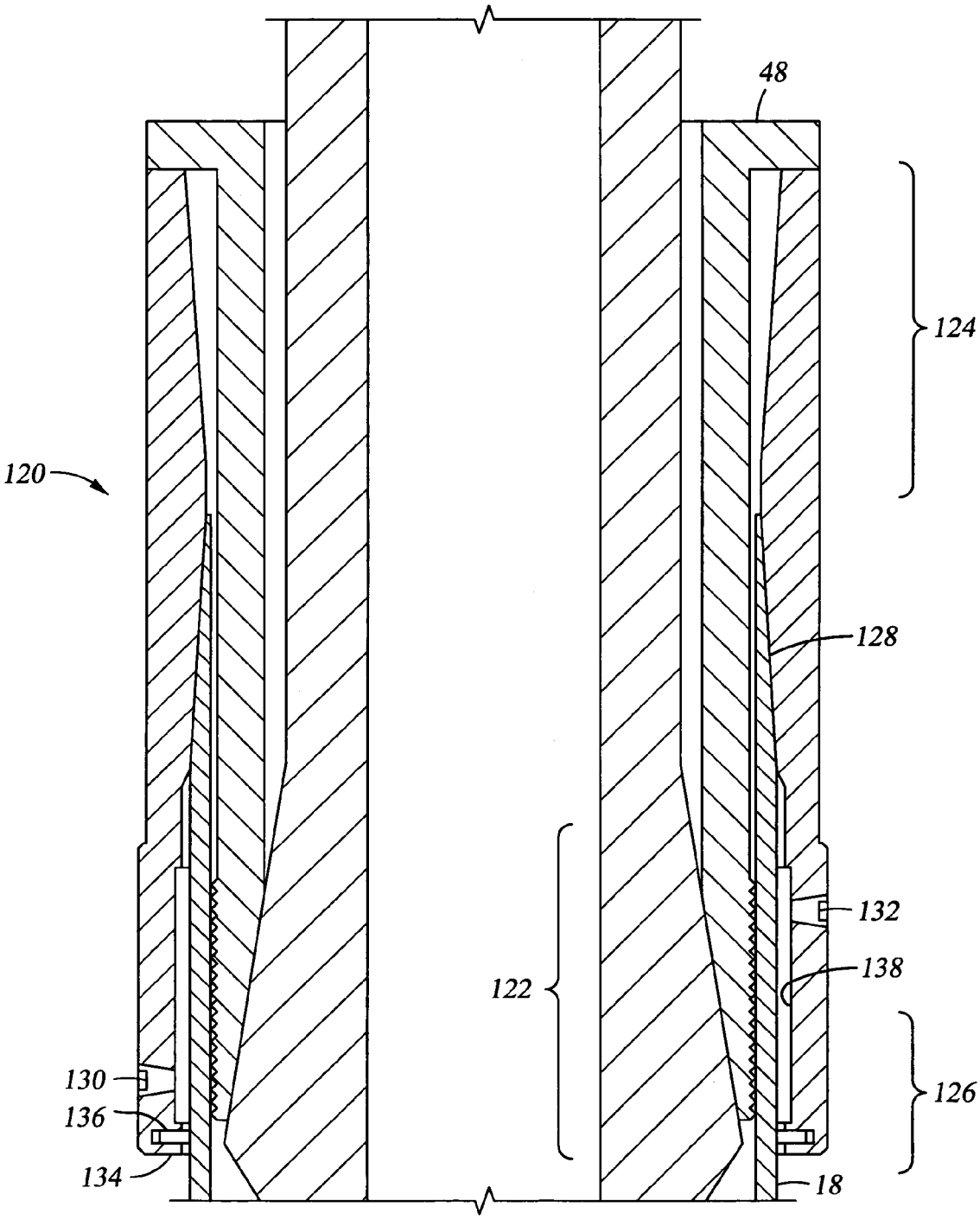
FIG. 12 is a sectional view of a collar disposed on a piece of casing.

In another aspect, FIG. 12 illustrates a casing collar 120 that may be used with embodiments described herein to provide a rigid exterior surface to the casing 18 opposite the loading position of the slips 48 therein, thereby enabling higher loading of the slips 48 against the interior of the casing 18 without the risk of deformation or rupture of the casing 18. In the embodiment shown, the casing collar 120 is positioned about, and spaced from, the outer circumference of the envelope formed by the slips 48. In this position, the casing collar 120 extends along the outside of the casing 18 to an area that largely overlaps a contact area 122 of the slips 48 of the spear (not shown). The collar 120 includes a first end 124, a second end 126 that preferably extends to a position below the lowest terminus of the slips 48, a generally circumferential inner surface having threaded portion 128 adjacent the first end 124, and a recessed portion 138 adjacent the second end 126. Immediate to the second end 126 of the casing collar 120 is an inwardly projecting flange 134 having a seal 136 disposed therein. A fill aperture 130 and a vent aperture 132 located on opposed sides of the casing collar 120 provide communication with the recessed portion 138. The apertures 130, 132 may be plugged with plugs (not shown).

To use the casing collar 120, the casing collar 120 is first slipped over a length of casing 18 and a filler material is injected through the fill aperture 130 into the recess 138 that is bounded by the casing collar 120 and the casing 18 while the recess 138 is vented out the vent aperture 132. The filler material is a fast setting, low viscosity fluid such as an Alumilite urethane resin made by Alumilite Corp. in Kalamazoo, Mich. that sets up in three minutes after mixing, pours like water, and withstands drilling temperatures and pressures once cured. The filler material conforms to all casing abnormalities and transfers the load from the casing 18 to the collar 120 to increase the effective burst strength of the casing 18 when slips 48 are loaded against the inside of the casing 18. The recess 138 may be undercut as shown or may be tapered, grooved, knurled, etc. to aid in retaining the filler material. The filler material creates a continuous bearing surface between the outer diameter (OD) of the casing 18 and the collar 120 where there would otherwise be gaps caused by irregularities in the casing OD and circularity. Further, the filler material does not pose a disposal hazard and adds no components to the wellbore. The use of the collar 120 and filler material allows for greater loading of the slips 48 within the casing 18, such as where thousands of feet of casing are suspended by the slips 48, by substantially reducing the risk of rupture or plastic deformation of the casing 18. Thus, the collar 120 and filler material enables drilling deeper into the earth with casing 18.

As an alternative to the filler material, a mechanical wedge (not shown) may be positioned intermediate of the collar 120 and the casing 18. In another embodiment, a stabilizer (not shown) may be incorporated with the collar 120.

In another aspect, the present invention provides a method for drilling with casing comprising positioning a collar about an exterior of the casing, the collar having an inner circumferential recess formed therein; filling at least a portion of the recess with a filler material; clamping a top drive adapter to the inside of the casing opposite the recess of the collar; and rotating the top drive adapter and casing, thereby drilling with the casing.

In another aspect, the present invention provides a gripping apparatus of use in servicing a wellbore comprising a body having a contact surface for gripping a tubular; a first engagement member having a first height disposed on the contact surface; and a second engagement member having a second height disposed on the contact surface. In one embodiment, a change in load supported by the first engaging member causes the second engaging member to engage the tubular.

While the foregoing is directed to embodiments of the present invention, other and further embodiments of the invention may be devised without departing from the basic scope thereof, and the scope thereof is determined by the claims that follow.

We claim:

1. A tubular gripping member for use with a top drive to handle a tubular, comprising:

a body connectable to the top drive, wherein the body can be rotated by the top drive;

one or more slips coupled to the body, the one or more slips actuatable to engage the tubular; and a first engaging member disposed on the one or more slips, the first engaging member having a first height extending from a face of the one or more slips; and a second engaging member disposed on the one or more slips, the second engaging member having a second height extending from the face.

2. The tubular gripping member of claim 1, wherein a change in a load supported by the first engaging member causes the second engaging member to engage the tubular.

3. The tubular gripping member of claim 1, wherein the tubular gripping member is adapted to maintain engagement with the tubular while a compression force is transmitted to the tubular.

4. The tubular gripping member of claim 1, wherein the body and the one or more slips have mating surfaces such that relative axial movement between the body and the one or more slips causes the one or more slips to move radially relative to the body.

5. The tubular gripping member of claim 1, wherein the first engaging member is capable of supporting a first load, and the second engaging member is adapted to engage the tubular when a second load acts on the tubular gripping member, wherein the second load is greater than the first load.

6. The tubular gripping member of claim 1, wherein the first engaging member comprises a wicker.

7. A system for suspending and turning a tubular drill string, comprising:

a top drive;

an internal gripping member driven by the top drive, the internal gripping member comprising a body, one or more slips, and an actuator for urging the one or more slips into engagement with an interior surface of the tubular drill string; and an external gripping member having a plurality of radially movable jaw members for engaging an outside portion of the tubular drill string, wherein the external gripping member is connected to one or more bails and is adapted to selectively engage the internal gripping member for rotation therewith.

8. The system of claim 7, wherein the one or more slips include a plurality of wickers extending therefrom, the wickers having variable heights.

9. The system of claim 7, further comprising a collar disposed about an exterior of the tubular drill string and a conforming element disposed between the collar and the exterior of the tubular drill string.

10. The system of claim 7, wherein the one or more bails is connected by a swivel to the top drive.

11. The system of claim 10, further comprising a lifting device that raises and lowers the external gripping member along the one or more bails.

12. The system of claim 10, wherein at least a portion of the external gripping member freely rotates with the tubular drill string.

13. The system of claim 7, wherein the external gripping member has a mating end, and the internal gripping member has a corresponding mating end that engages with the mating end of the external gripping member to transmit rotational forces therebetween.

14. The system of claim 7, wherein the tubular drill string comprises casing.

15. The system of claim 7, wherein the actuator comprises a biasing member that urges the one or more slips a distance in one direction and a swivel mechanism that selectively controls the length of the distance.

16. The system of claim 7, wherein the actuator comprises a spindle drive.

17. The system of claim 7, wherein the jaw member for engaging the tubular is hydraulically actuated.

18. The system of claim 17, wherein the jaw member is piston actuated.

19. The system of claim 7, wherein the actuator is actuated mechanically, hydraulically, or pneumatically.

20. The system of claim 7, wherein the external gripping member is disengageable from the internal gripping member for independent movement.

21. A tubular gripping member for use with a top drive to handle a tubular, comprising:

a body connectable to the top drive;

one or more slips coupled to the body, the one or more slips actuatable to engage the tubular; and a first engaging member disposed on the one or more slips, the first engaging member having a first height extending from a face of the one or more slips; and a second engaging member disposed on the one or more slips, the second engaging member having a second height extending from the face, wherein a change in a load supported by the first engaging member causes the second engaging member to engage the tubular.

22. A tubular gripping member for use with a top drive to handle a tubular, comprising:

a body connectable to the top drive;

one or more slips coupled to the body, the one or more slips actuatable to engage the tubular; and a first engaging member disposed on the one or more slips, the first engaging member having a first height extending from a face of the one or more slips; and a second engaging member disposed on the one or more slips, the second engaging member having a second height extending from the face, wherein the first engaging member is capable of supporting a first load, and the second engaging member is adapted to engage the tubular when a second load acts on the tubular gripping member, wherein the second load is greater than the first load.

23. A method for suspending and turning a casing using a top drive, comprising:

gripping an outside of the casing with a second gripping member;

moving the second gripping member axially toward a first gripping member;

rotating the casing to make up a connection between the casing and a casing drill string;

actuating the first gripping member to engage the inside of the casing; and providing a thrust force to the casing drill string, the thrust force at least partially transferred to the casing drill string through the first gripping member.

24. The method of claim 23, further comprising axially moving the second gripping member to compensate for motion of the casing caused by the make-up of the connection.

25. The method of claim 23, further comprising pivoting the second gripping member into alignment with the first gripping member.

26. The method of claim 23, further comprising coupling the second gripping member to the first gripping member such that torque is transferable therebetween.

27. A method for suspending and turning a casing using a top drive, comprising:

gripping an exterior surface of the casing with a second gripping member;

moving the casing and the second gripping member into vertical alignment with a first gripping member;

moving the second gripping member into engagement with the first gripping member;

rotating the casing to make up a connection between the casing and a casing drill string;

actuating a first gripping member to engage an interior surface of the casing; and providing a thrust force to the casing drill string, the thrust force at least partially transferred to the casing drill string through the first gripping member.

28. The method of claim 27, further comprising axially moving the second gripping member to compensate for motion of the casing caused by the make-up of the connection.

29. The method of claim 27, wherein actuating the one or more slips including a plurality of wickers having variable heights extending therefrom.

30. The method of claim 27, further comprising positioning a collar about an exterior of the casing drill string.

31. The method of claim 30, further comprising placing a conforming element between the collar and the exterior of the casing drill string.

32. The method of claim 27, wherein the second gripping member is mounted on bails connected by a swivel to the top drive.

33. The method of claim 27, wherein at least a portion of the second gripping member freely rotates with the casing drill string.

34. The method of claim 27, wherein the first gripping member comprises a spear.

35. The method of claim 27, wherein the second gripping member comprises an external gripping member.

36. A tubular gripping apparatus for use with a top drive to handle a tubular, comprising:

an internal gripping member having one or more slips for engaging an interior surface of the tubular, wherein the internal gripping member is rotatable by the top drive; and an external gripping member having a plurality of radially movable jaw members for engaging an exterior surface of the tubular, wherein the external gripping member is connected to one or more bails and is adapted to selectively engage the internal gripping member for rotation therewith.

37. The apparatus of claim 36, wherein the external gripping member is movable along the one or more bails to selectively engage the internal gripping member.

38. The apparatus of claim 36, wherein the one or more bails pivotable to move the external gripping member into and out of axial alignment with the internal gripping member.

39. A tubular gripping apparatus for use with a top drive to handle a tubular, comprising:

a circulating tool insertable into the tubular and rotatable by the top drive; and an external gripping member having a plurality of radially movable jaw members for engaging an exterior surface of the tubular, wherein the external gripping member is connected to one or more bails and is adapted to selectively engage the circulating tool for rotation therewith.

40. The apparatus of claim 39, wherein the circulating tool comprises one or more slips to engage an interior surface of the tubular.

41. The apparatus of claim 39, wherein the circulating tool comprises an annular seal.

42. A method for suspending and turning a casing using a top drive, comprising:

gripping an exterior surface of the casing with an external gripping member;

moving the casing and the external gripping member into vertical alignment with a circulating tool;

moving the external gripping member into engagement with the circulating tool;

rotating the casing to make up a connection between the casing and a casing drill string;

supplying fluid into the casing; and providing a rotating force to the casing drill string, the rotating force at least partially transferred to the casing drill string through the external gripping member.

43. The method of claim 42, wherein the circulating tool comprises one or more slips and the method further comprises actuating the one or more slips to engage an interior surface of the casing.

44. The method of claim 42, further comprising axially moving the external gripping member to compensate for motion of the casing caused by the make-up of the connection.

45. The method of claim 42, wherein the external gripping member is mounted on bails connected by a swivel to the top drive.

* * * * *